US008647143B2

(12) United States Patent
Kodama

(10) Patent No.: US 8,647,143 B2
(45) Date of Patent: Feb. 11, 2014

(54) TERMINAL MODULE HAVING A HOUSING WITH A PLURALITY OF SLITS WITH VARYING WIDTHS AND AN INCLINED GUIDE SURFACE

(75) Inventor: Hidetoshi Kodama, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 18 days.

(21) Appl. No.: 13/442,034

(22) Filed: Apr. 9, 2012

(65) Prior Publication Data

US 2012/0258637 A1 Oct. 11, 2012

(30) Foreign Application Priority Data

Apr. 8, 2011 (JP) ..... 2011-086102

(51) Int. Cl.
*H01R 13/64* (2006.01)

(52) U.S. Cl.
USPC ..... 439/374

(58) Field of Classification Search
USPC ..... 439/70–74, 355, 676, 367–374
See application file for complete search history.

(56) References Cited

U.S. PATENT DOCUMENTS

| | | | | | |
|---|---|---|---|---|---|
| 3,848,953 | A * | 11/1974 | Petroshanoff | 439/327 |
| 5,449,299 | A * | 9/1995 | Shimirak et al. | 439/417 |
| 5,899,768 | A * | 5/1999 | Kameyama | 439/374 |
| 6,402,559 | B1 * | 6/2002 | Marowsky et al. | 439/676 |
| 6,808,427 | B1 * | 10/2004 | Xue | 439/676 |
| 7,258,567 | B2 * | 8/2007 | Tanaka et al. | 439/355 |
| 7,753,693 | B2 * | 7/2010 | Osato et al. | 439/71 |
| 8,342,875 | B2 * | 1/2013 | Takeuchi | 439/374 |
| 8,398,425 | B2 * | 3/2013 | Suzuki et al. | 439/374 |
| 2005/0009410 | A1 * | 1/2005 | Cheng et al. | 439/676 |
| 2006/0019511 | A1 * | 1/2006 | Tanaka et al. | 439/74 |
| 2009/0104795 | A1 * | 4/2009 | Osato et al. | 439/70 |
| 2010/0022104 | A1 * | 1/2010 | Osato et al. | 439/65 |
| 2012/0171905 | A1 * | 7/2012 | Koyama et al. | 439/676 |

FOREIGN PATENT DOCUMENTS

| | | |
|---|---|---|
| JP | 2000-208184 | 7/2000 |
| JP | 2007-124461 A | 5/2007 |
| JP | 4238863 B2 | 1/2009 |

* cited by examiner

*Primary Examiner* — Chandrika Prasad

(57) ABSTRACT

A terminal module includes a housing having slits and a plurality of contact terminals mounted in the slits. A slit width in an arrangement direction of the slit is greater on an insertion position side than that at a mounting position. The housing has a guide portion which is formed along the insertion direction of the slits, has a guide surface inclined toward the mounting position side from the insertion position, and guides the contact terminal toward a mounting completion position as a tip end of an insertion side of the contact terminal reaches the guide surface.

9 Claims, 19 Drawing Sheets

TERMINAL MODULE HAVING A HOUSING WITH A PLURALITY OF SLITS WITH VARYING WIDTHS AND AN INCLINED GUIDE SURFACE

Priority is claimed under 35 U.S.C. §119 to Japanese Application No. 2011-086102 filed on Apr. 8, 2011 which is hereby incorporated by reference in its entirety.

BACKGROUND

1. Technical Field

The present invention relates to a terminal module and a recording apparatus using the terminal module.

2. Related Art

Hitherto, as a terminal module, a connector of JP-A-2000-208184 has become known. The connector includes a plurality of contacts accommodated in a housing. That is, the housing includes a plurality of slits in an arrangement direction, and the contacts are respectively inserted into the corresponding slits. The contact includes a contact arm and a contact portion at the tip end of the contact arm, and the contact portion is pressed against a terminal of an external circuit board so as to bend the contact arm for electrical connection.

However, in the connector according to the related art, since the slits are formed with a small width, when the contacts are bent, there are problems in that the contacts are caught on the wall surface that forms the slit and mounting of the contacts in the housing is not smoothly performed.

SUMMARY

An advantage of some aspects of the invention is that it provides a terminal module capable of smoothly inserting contact terminals into slits formed in a housing and a recording apparatus using the terminal module.

Application Example 1

According to an aspect of the invention, there is provided a terminal module including: a housing having a plurality of slits arranged in parallel to each other; and a plurality of contact terminals each of which has an arm and a contact piece formed at one end of the arm and which are mounted in the slits by being inserted into mounting positions from insertion positions of the slits in an insertion direction intersecting an arrangement direction of the slits, the contact pieces being connected to external terminals as the arms are elastically deformed in a bending direction aligned with a depth direction of the slits, wherein a slit width in the insertion direction is greater than a slit width at the mounting position, and the housing has a guide portion which is formed along the insertion direction of the slits, has a guide surface inclined toward the mounting position from the insertion position, and guides the contact terminal toward the mounting position as a tip end of an insertion side of the contact terminal reaches the guide surface.

In Application Example 1, since the guide portion is formed along the insertion direction of the slits and has the guide surface inclined toward the mounting position from the insertion position, when the contact terminals are inserted toward the mounting position from the insertion position of the slits, the contact terminal is guided by the guide surface. Therefore, even when the contact terminals have slight warpage or bending, the contact terminals may be smoothly inserted into the slits, so that the yield during an assembly operation may be enhanced.

Application Example 2

In the terminal module for a recording apparatus, a plurality of the guide surfaces may be formed so that the slit width of the mounting position is reduced from the insertion position toward the mounting position in stages.

Since the plurality of the guide surfaces of

Application Example 2 are formed to be narrowed in stages, a great force toward the mounting position is not abruptly exerted on the contact terminal, and the contact terminals may be inserted into the slits more smoothly.

Application Example 3

In the terminal module for a recording apparatus, the guide portion may be provided to only a part of the plurality of slits, each of the plurality of contact terminals may have a first contact terminal and a second contact terminal, and a tip end side of the first contact terminal may be disposed on a side further forwards in the insertion direction than a tip end side of the second contact terminal, and the first contact terminal may be disposed to be mounted in the slit having the guide portion.

According to Application Example 3, since positioning of the plurality of contact terminals may be reliably performed with a few guide portions and thus the guide portion is not provided in all the slits, walls forming the slits are not made unnecessarily complex, and degradation of mechanical strength of the housing is not caused.

Application Example 4

In the terminal module for a recording apparatus, the plurality of slits having the guide portions may be disposed to be symmetric with respect to a center shaft in the arrangement direction in the housing.

In Application Example 4, since the slits are disposed to be symmetric with respect to the center shaft in the arrangement direction in the housing, the plurality of contact terminals may be inserted into the slits more smoothly with a good balance in the arrangement direction of the contact terminals.

Application Example 5

In the terminal module for a recording apparatus, the housing may have a guide seat which is formed on an insertion position side of the slit and restrict a position of the contact terminal in the bending direction by reaching a tip end of the contact terminal.

According to Application Example 5, the guide seat restricts the position in the bending direction by supporting the tip end of the contact terminal during the assembly operation of the contact terminals, thereby inserting the contact terminals into the slits more smoothly.

Application Example 6

In the terminal module for a recording apparatus, the first and second contact terminals may have the same shape, and the contact pieces may be disposed at different positions in the insertion direction.

According to Application Example 6, even in the contact terminals with the same shape, many contact pieces may be disposed in a narrow range.

Application Example 7

In the terminal module for a recording apparatus, a chamfered portion may be formed at a tip end of the contact terminal to reduce frictional resistance when coming in contact with the guide surface.

Since the chamfered portion of Application Example 7 reduces the frictional resistance when coming in contact with the guide surface, the contact terminals may be inserted into the slits more smoothly.

Application Example 8

The terminal module may further include: a stopper end which is provided at the tip end of the contact terminal; and a locking end which restricts outward movement of the contact terminal from the slits in the bending direction by being locked by the stopper end at the mounting position of the slit in the housing.

According to Application Example 8, since the stopper end of the contact terminal is positioned by the locking end of the housing at the mounting position of the contact terminal, the contact terminal is reliably positioned with respect to the housing, and thus backlash may be prevented.

Application Example 9

In the terminal module, the contact terminal may be formed in a shape in which two parallel sides are connected with the arm, and the contact pieces may be formed at both ends of the arm so as to move outside the slit on an opposite side to the bending direction.

Application Example 10

A recording apparatus includes: the terminal module; and a recording material accommodation container having container side terminals which are electrically connected to the contact terminals of the terminal module.

BRIEF DESCRIPTION OF THE DRAWINGS

The invention will be described with reference to the accompanying drawings, wherein like numbers reference like elements.

DESCRIPTION OF EXEMPLARY EMBODIMENTS

1. Configuration of Liquid Ejecting Apparatus

Figure 1:
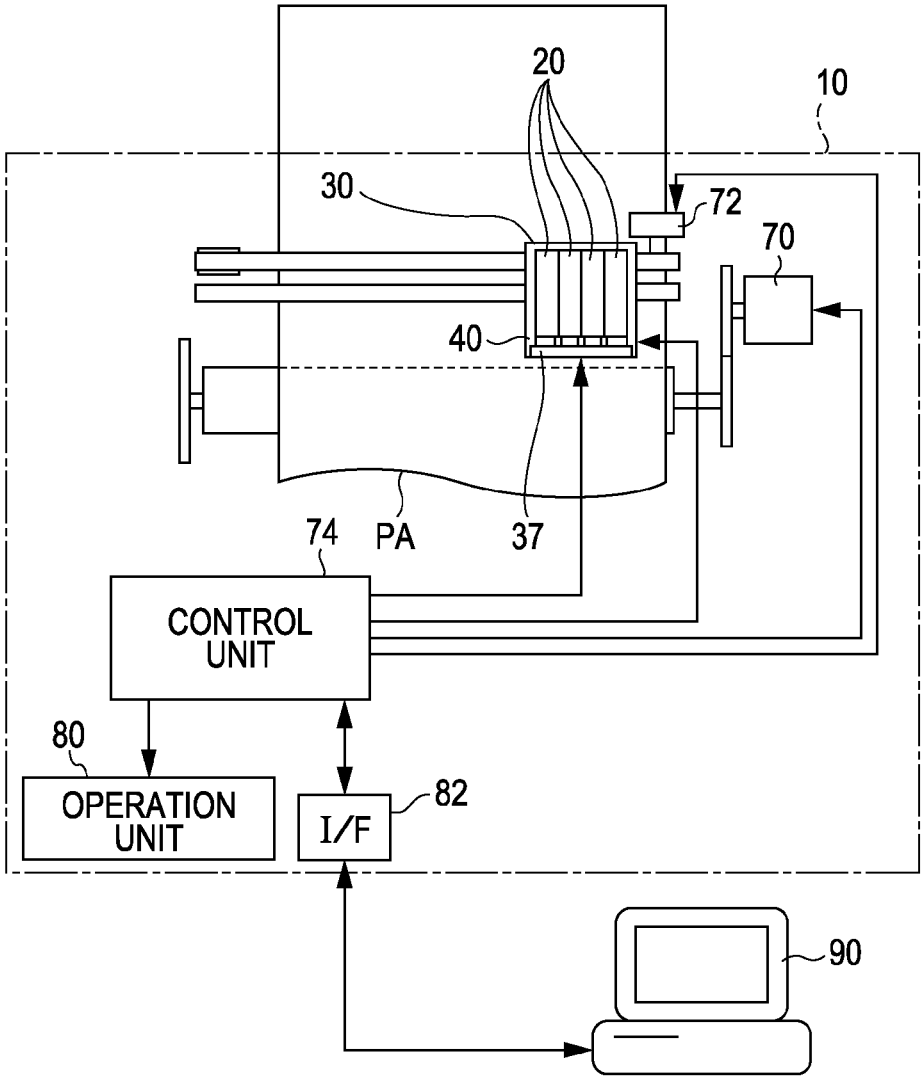
FIG. 1 is a diagram illustrating the schematic configuration of a liquid ejecting apparatus using a terminal module according to an embodiment of the invention.

FIG. 1 is a diagram illustrating the schematic configuration of a liquid ejecting apparatus 10 (recording apparatus) using a terminal module according to an embodiment of the invention. The liquid ejecting apparatus 10 is an ink jet printer 10 that performs printing by ejecting ink onto a printing sheet PA. The ink jet printer 10 includes a cartridge 20 (a recording material accommodation container), a holder 30, a first motor 72, a second motor 70, a control unit 74, an operation unit 80, and a predetermined interface 82.

The holder 30 includes a print head (not shown) which discharges ink toward a side opposing the printing sheet PA, and a plurality of the cartridges 20 mounted to be detachable. The cartridges 20 accommodate corresponding inks (recording materials) including cyan, magenta, yellow, and the like. The ink accommodated in the cartridge 20 is supplied to the print head of the holder 30, and the ink is discharged onto the printing sheet PA.

The first motor 72 drives the holder 30 in a main scanning direction. The second motor 70 transports the printing sheet PA in a sub-scanning direction. The control unit 74 controls the overall operations of the ink jet printer 10. The control unit 74 controls the first motor 72, the second motor 70, and the print head on the basis of print data received from a computer 90 or the like connected via the predetermined interface 82, thereby performing printing. The control unit 74 is connected to the operation unit 80 and receives various operations from users.

2. Schematic Configuration of Cartridge 20 and Holder 30

Figure 2:
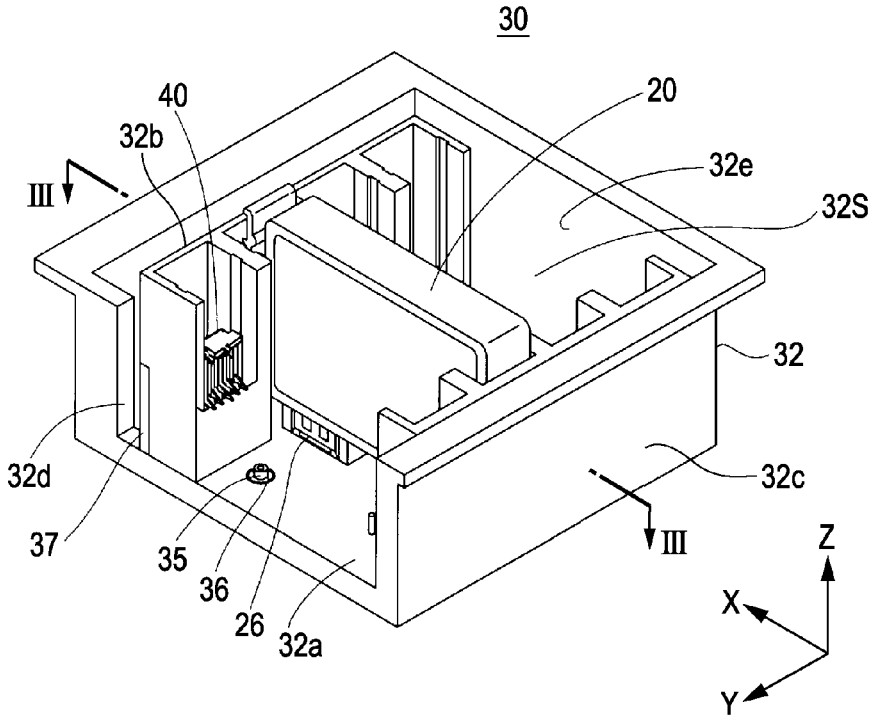
FIG. 2 is a perspective view of the outer appearance of a holder in which a cartridge is mounted.
Figure 3:
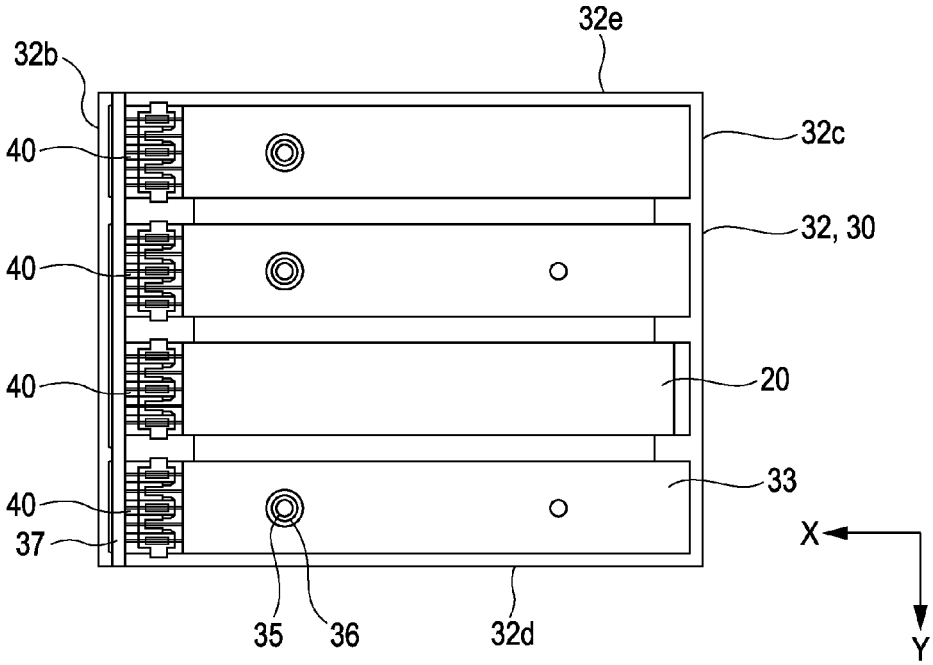
FIG. 3 is a plan view illustrating the holder in which the cartridge is mounted.

FIG. 2 is a perspective view of the outer appearance of the holder 30 in which the cartridge 20 is mounted, and FIG. 3 is a plan view illustrating the holder 30 in which the cartridge 20 is mounted. For the convenience of description, FIGS. 2 and 3 illustrate a state where the single cartridge 20 is mounted in the holder 30. In addition, in order to specify the directions, XYZ axes which are orthogonal to each another are shown in FIG. 2. In the figures shown hereinafter, XYZ axes which are orthogonal to each another are shown as needed. Here, as a usage posture of the ink jet printer 10, the main scanning direction of the ink jet printer 10 is the Y axis direction, and the sub-scanning direction is the X axis. In addition, the Z axis direction is the vertical direction, and the negative Z axis direction is a vertically downward direction.

The cartridge 20 is held in the holder 30 and is connected to the control unit 74 side via a terminal module 40. The holder 30 has a configuration in which four cartridges 20 are able to be mounted. In addition, the number of cartridges 20 that are able to be mounted in the holder 30 is not limited to 4, and the configuration of the holder 30 may be changed depending on the number of cartridges 20 required for mounting.

2-1. Configuration of Cartridge 20

Figure 4:
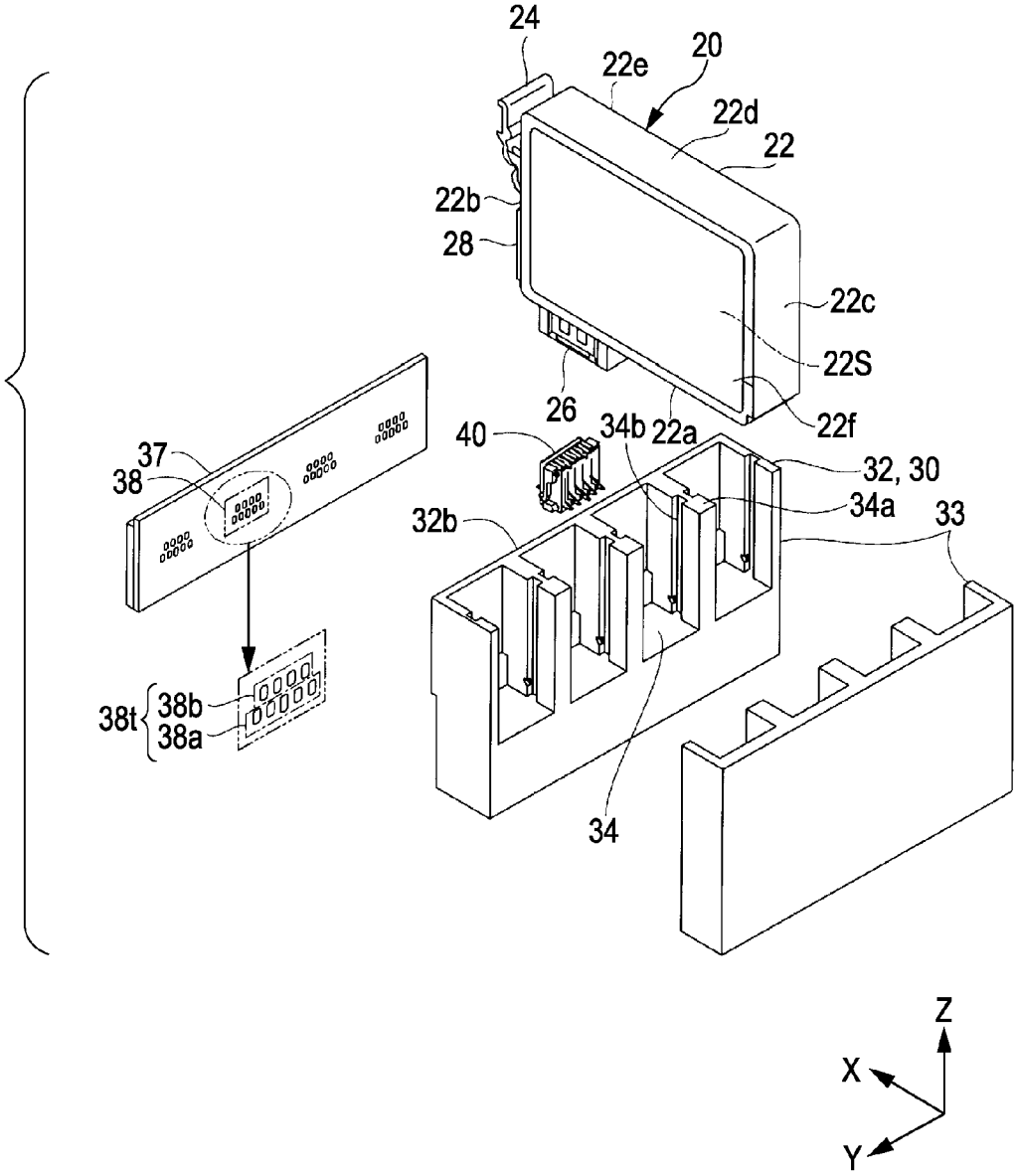
FIG. 4 is a perspective view illustrating a state where the cartridge and the like are removed from the holder.

FIG. 4 is a perspective view illustrating a state where the cartridge 20 and the like are removed from the holder 30. In FIG. 4, the cartridge 20 includes a container body 22, a lever 24, a liquid supply port 26, and a circuit board 28. The container body 22, the lever 24, and the liquid supply port 26 are formed of a synthetic resin such as polypropylene. The container body 22 has a bottom face portion 22*a*, a front face portion 22*b*, a rear face portion 22*c*, an upper face portion 22*d*, a left face portion 22*e*, and a right face portion 22*f*, and these face portions constitute substantially a rectangular parallelepiped in which a liquid accommodation chamber 22S is formed for accommodating ink.

The lever 24 is the front face portion 22*b*, and the lower end surface of the lever 24 is mounted in the front face portion 22*b* so that the lever 24 has a shape extending upward from the lower end surface. The lever 24 has elasticity and is elastically deformed in the longitudinal direction (X axis direction) by an external force, and is a stopper mechanism for attaching and detaching the cartridge 20 to and from the holder 30 by being engaged with and disengaged from a part of the holder 30.

The liquid supply port 26 is provided in the bottom face portion 22*a* and is a passage through which the ink in the liquid accommodation chamber 22S is circulated toward the outside such that the ink is circulated toward the print head (not shown). A sponge-like foam is disposed in the liquid supply port 26, thereby preventing leakage of the ink from the liquid supply port 26. In addition, in the lower face portion 22*a*, an air opening hole (not shown) is formed to introduce air to the inside as the ink in the liquid accommodation chamber 22S is consumed.

Figure 5:
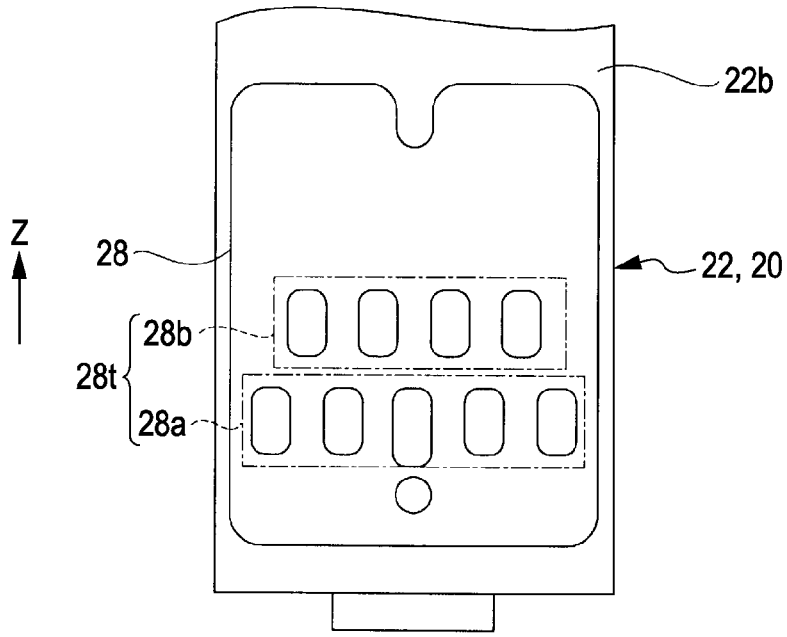
FIG. 5 is a side view illustrating the vicinity of a circuit board of the cartridge.

FIG. 5 is a side view illustrating the vicinity of the circuit board 28 of the cartridge 20. The circuit board 28 is mounted in the lower portion of the front face portion 22*b* of the cartridge 20 (see FIG. 4) and includes a terminal group 28*t* of nine terminals (container side terminals) disposed on the surface and a storage unit (not shown) disposed on the rear surface so as to store information regarding ink (for example, a remaining ink amount and ink colors) of the cartridge 20 in the storage unit. The terminals of the terminal group 28*t* are formed substantially in a rectangular shape, and terminal rows 28*a* and 28*b* are disposed to form two rows which are substantially perpendicular to the direction Z and are alternately disposed in a zigzag form. The terminal rows 28*a* and 28*b* are disposed on the upper side in the direction Z and on the lower side in the direction Z, respectively. These terminals include a mounting detection terminal, a reset terminal, a clock terminal, a power supply terminal, a ground terminal, a data terminal, and the like having the corresponding functions (purposes). In addition, a connection configuration of the circuit board 28, the terminal module 40, and the like will be described later.

2-2. Configuration of Holder 30

In FIG. 2, the holder 30 has a concave shape in which a part of the holder 30 is open so as to enable the cartridge 20 to be attached and detached, and is formed of a synthetic resin such as polypropylene. The holder 30 has a bottom wall face portion 32*a*, a front wall face portion 32*b*, an opposing wall face portion 32*c*, a side wall face portion 32*d*, and a side wall face portion 32*e*. Through these wall face portions 32*a* to 32*e*, a cartridge accommodation chamber 32S accommodating the cartridge 20 is formed. In addition, for the convenience of description of FIG. 2, the side wall face portion 32*d* is cut off.

In FIG. 4, in a holder case 32 of the holder 30, cartridge mounting portions 33 (recording material accommodation container mounting portions) for holding the cartridges 20 are formed. The cartridge mounting portions 33 are configured by partition walls 34*a* for holding and positioning the corresponding cartridges 20. On the front wall face portion 32*b* (see FIG. 2) side of the cartridge mounting portion 33, a terminal mounting portion 34 for holding the terminal module 40 is formed. In addition, the terminal mounting portion 34 will be described later on the basis of the relationship with the terminal module 40.

In FIG. 2, a liquid supply tube 35 and a seal member 36 are mounted in the bottom wall face portion 32*a*. One end side of the liquid supply tube 35 is connected to the print head (not shown) mounted in the rear surface (the surface on the negative direction side in the Z axis) of the bottom wall face portion 32*a*. In addition, when the cartridge 20 is mounted in the holder 30, the other end side of the liquid supply tube 35 is connected to the liquid supply port 26 of the cartridge 20. The seal member 36 is a member having elasticity, such as, a synthetic rubber. The seal member 36 is disposed in the periphery of the liquid supply tube 35 so as to prevent the ink from leaking to the outside when the cartridge 20 is mounted in the holder 30. Therefore, when the cartridge 20 is mounted in the holder 30, as the ink jet printer 10 is driven, the ink inside the cartridge 20 is supplied to the print head via the liquid supply port 26.

Figure 6:
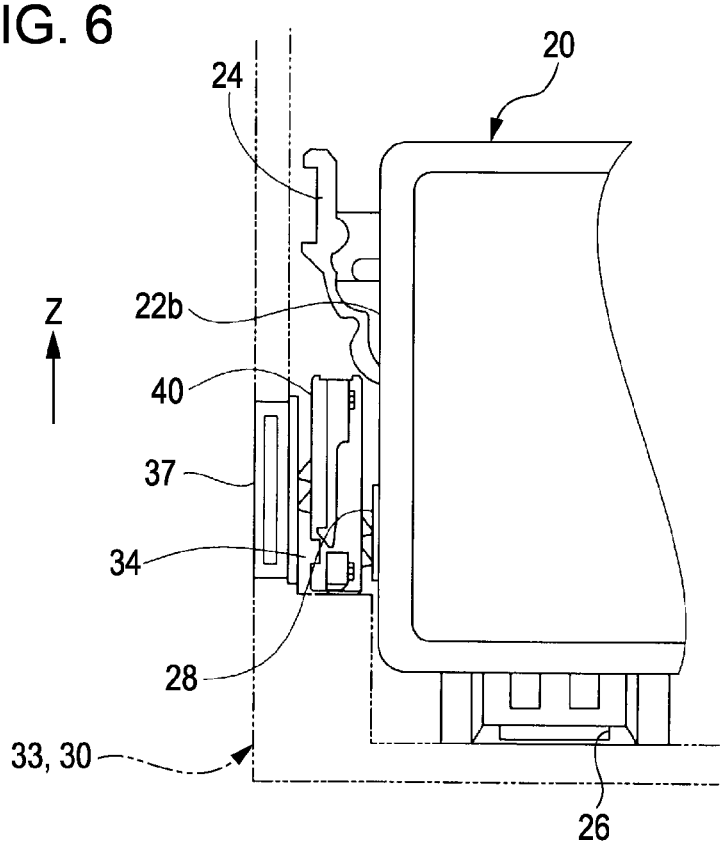
FIG. 6 is an explanatory view illustrating the connection structure of the cartridge and the terminal module.

FIG. 6 is an explanatory view illustrating the connection structure of the cartridge 20 and the terminal module 40. At the lower portion (on the downward side in the Z direction) of the cartridge mounting portion 33 of the holder 30, the terminal mounting portion 34 is formed, and a body side circuit board 37 is mounted in the terminal mounting portion 34. As illustrated in FIG. 4, in the body side circuit board 37, four contact point mechanisms 38 to be respectively connected to the circuit board 28 are formed to correspond to the number of cartridges 20. In each of the contact point mechanisms 38, a terminal group 38*t* of nine terminals is formed to correspond to the terminal group 28*t* (FIG. 5) of the circuit board 28. The terminal group 38*t* has terminal rows 38*a* and 38*b* disposed in two stages, and the terminals are alternately disposed in a zigzag form. The contact point mechanism 38 is used to electrically connect the circuit board 28 of the cartridge 20 to the control unit 74 of the ink jet printer 10 via the terminal module 40.

3. Configuration of Terminal Module 40

Figure 7:
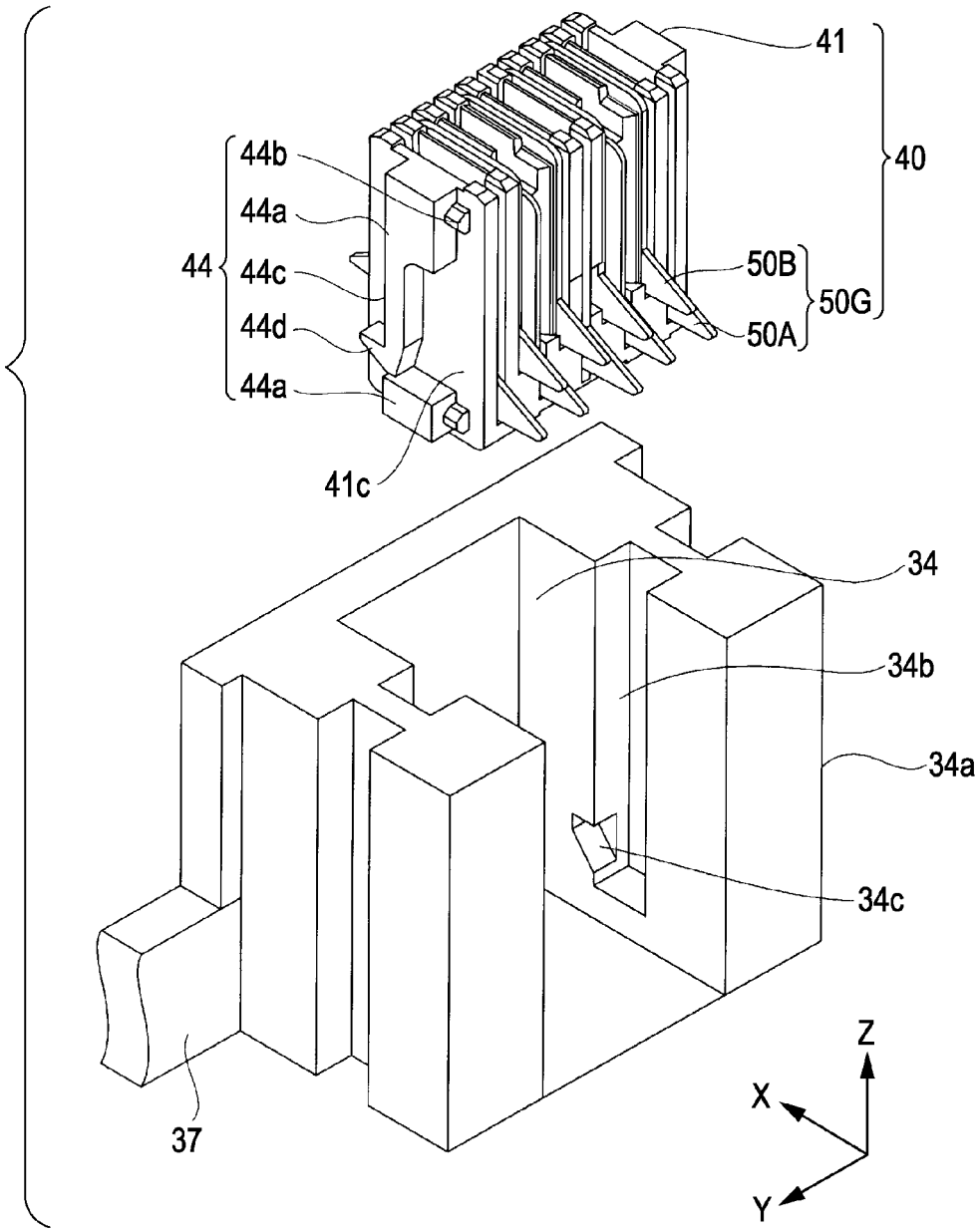
FIG. 7 is a perspective view illustrating a state where the terminal module is removed from the terminal mounting portion of the holder.
Figure 8:
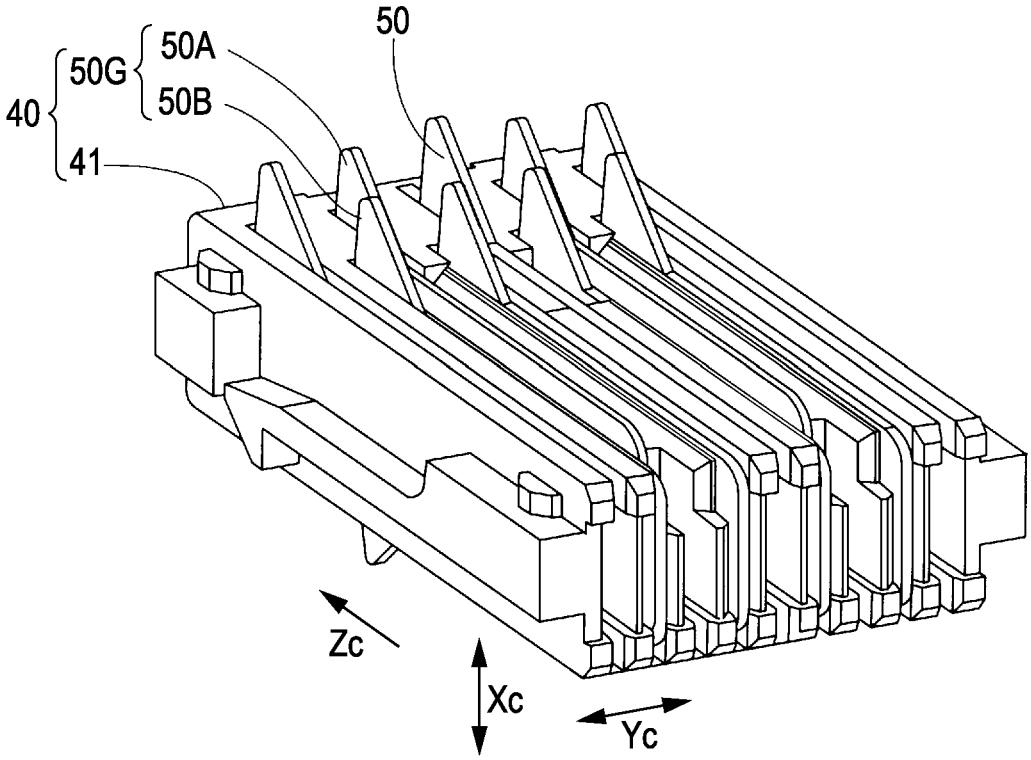
FIG. 8 is a perspective view illustrating the terminal module.
Figure 9:
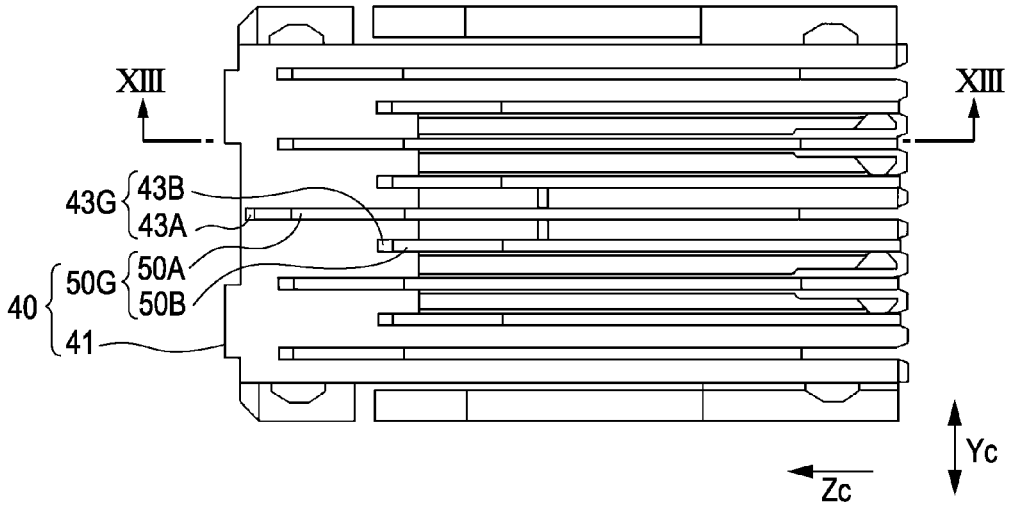
FIG. 9 is a plan view illustrating the terminal module.

FIG. 7 is a perspective view illustrating a state where the terminal module 40 is removed from the terminal mounting portion 34 of the holder 30. The terminal module 40 is mounted in the terminal mounting portion 34 of the holder 30 and is a double-sided terminal for electrical connection between the cartridge 20 and the contact point mechanism 38 of the body side circuit board 37 (see FIG. 6). FIG. 8 is a perspective view illustrating the terminal module 40, and FIG. 9 is a plan view illustrating the terminal module 40. The terminal module 40 has a housing 41 and a plurality of contact terminals 50 held by the housing 41. In addition, in the following description, in order to clarify the relationship between the housing 41 and the contact terminals 50, the directions X, Y, and Z described above are denoted by a bending direction Xc, an arrangement direction Yc, and an insertion direction Zc.

Figure 11:
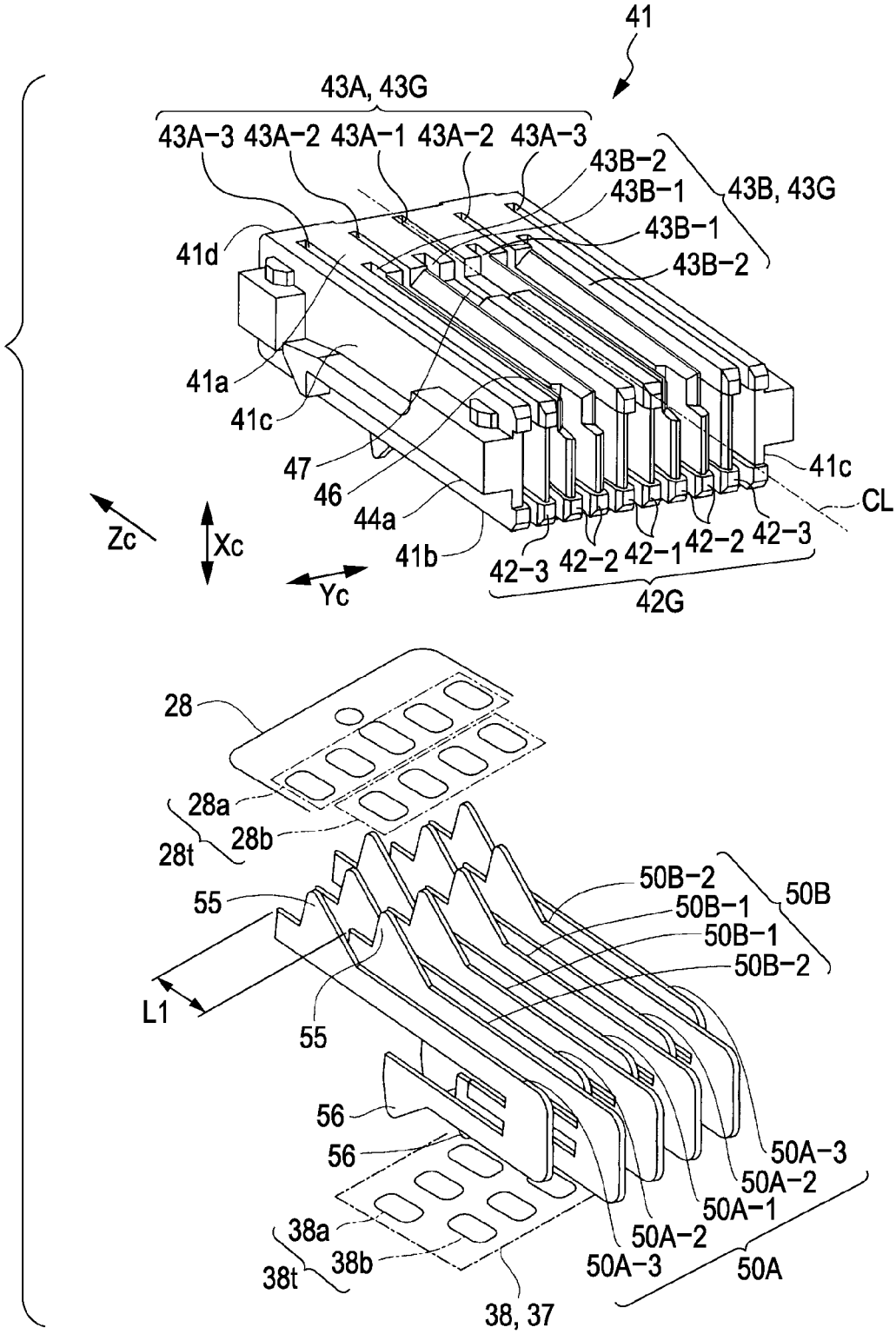
FIG. 11 is a perspective view illustrating a state before the contact terminals are mounted in the housing of the terminal module.

FIG. 11 is a perspective view illustrating a state before the contact terminals 50 are mounted in the housing 41 of the terminal module 40. The housing 41 includes a cassette side wall 41*a* (see FIG. 4) opposing the cartridge 20, a body board side wall 41*b* opposing the body side circuit board 37, side wall portions 41*c* and 41*c*, and a bottom wall portion 41*d*, and these walls form substantially a rectangular parallelepiped.

In the housing 41, a slit formation unit 42G protruding from the bottom wall portion 41*d* is disposed between the side wall portions 41*c* and 41*c*. The slit formation unit 42G includes a plurality of slits 43 formed in parallel to each other in order to mount a plurality (in the figures, nine) contact terminals 50.

The slit formation unit 42G includes three types of slit formation walls 42-1 to 42-3 arranged in the arrangement direction Yc to be symmetric with respect to a center shaft CL determined in the arrangement direction Yc of the housing 41, that is, includes two slit formation walls 42-1 disposed at the center, two slit formation walls 42-2 disposed on each of both sides of the slit formation wall 42-1, and slit formation walls 42-3 respectively disposed on both sides of the slit formation walls 42-2. The slit formation walls 42-1 to 42-3 of the slit formation unit 42G form a slit group 43G of two different kinds of slits 43A and 43B with different lengths in the insertion direction Zc.

That is, in the slits 43A, a slit 43A-1 which is long in the insertion direction Zc is formed by the slit formation walls 42-1 and 42-1, slits 43A-2 are formed by the slit formation walls 42-2 and 42-2, and slits 43A-3 are formed by slit formation walls 42-3 and the slide wall portions 41*c*.

In addition, in the slit 43B, slits 43B-1 which are shorter than the slits 43A in the insertion direction Zc are formed by the slit formation walls 42-1 and the slit formation walls 42-2, and slits 43B-2 are formed by the slit formation walls 42-2 and the slit formation walls 42-3. In addition, in the following description, in the case where the slit formation walls 42 are mentioned, the slit formation walls 42 represent the individual slit formation walls from among all the slit formation walls 42-1 to 42-3, and in the case where the slits 43A and 43B are mentioned, the slits 43A and 43B represent a set of slits with different lengths. In addition, the slit formation walls 42 and the slits 43A and 43B having characters attached thereto represent the individual slit formation walls and the slits.

Next, a configuration for mounting the terminal module 40 in the terminal mounting portion 34 will be described. In FIG. 7, in the side wall portion 41*c* of the housing 41, a side face support portion 44 for mounting the terminal module 40 in the terminal mounting portion 34 of the holder 30 is formed. The side face support portions 44 are configured to have the same shape at the side wall portions 41*c* on both sides, and each have two rail portions 44*a* protruding from the side wall portion 41*c*, a locking protrusion 44*b* formed on one side of the rail portion 44*a*, and an insertion position determination arm 44*c* which protrudes from the rail portion 44*a* and is elastically deformable. The rail portion 44*a* is formed to follow a guide groove 34*b* while being fitted to the guide groove 34*b*. As the locking protrusions 44*b* on both sides respectively abut on the opposing partition walls 34*a*, the position in the arrangement direction Yc is determined. At the tip end of the insertion position determination arm 44*c*, an engagement claw 44*d* is formed so as to be engaged with an engagement groove 34*c*.

In order to mount the terminal module 40 in the terminal mounting portion 34, first, the rail portion 44*a* of the terminal module 40 is positioned by the guide groove 34*b* of the partition wall 34*a*, and the terminal module 40 is then pressed down in the guide groove 34*b*. Here, the engagement claw 44*d* of the insertion position determination arm 44*c* is pressed against the wall face of the guide groove 34*b*, such that the insertion position determination arm 44*c* is bent. In addition, when the engagement claw 44*d* reaches the engagement groove 34*c*, the insertion position determination arm 44*c* is returned, such that the engagement claw 44*d* is engaged with the engagement groove 34*c*. Accordingly, the terminal module 40 is mounted in the terminal mounting portion 34. Similarly, as illustrated in FIG. 3, the terminal modules 40 may be mounted in the other three different cartridge mounting portions 33.

Figure 12:
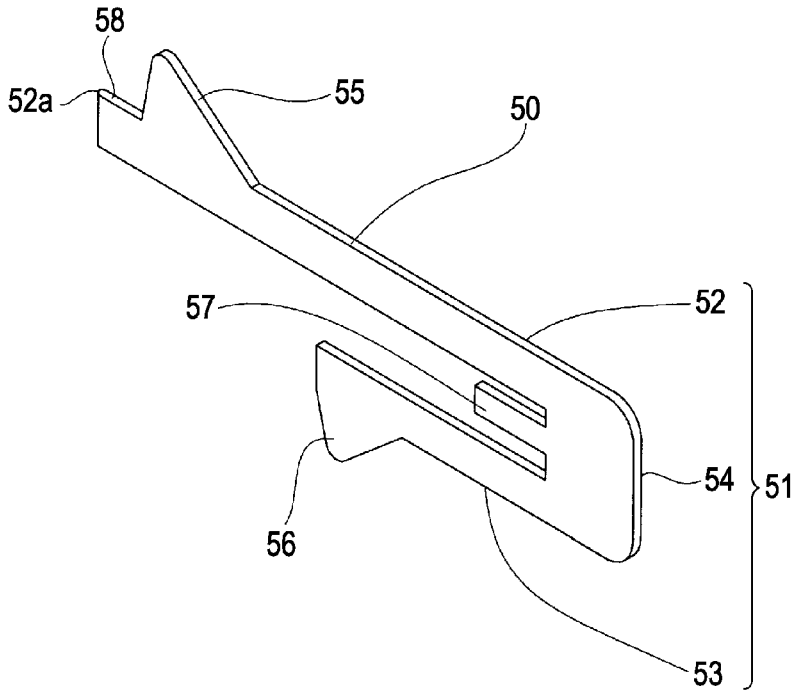
FIG. 12 is a perspective view illustrating one of the contact terminals.

FIG. 12 is a perspective view illustrating one of the contact terminals 50. In FIG. 12, the contact terminal 50 includes an arm 51 formed of a metal thin plate, contact pieces 55 and 56 (contact points), and a locked portion 57. The arm 51 has a long side 52, a short side 53, and a connection portion 54, and is configured by connecting the long side 52 and the short side 53, which are two parallel sides, with the connection portion 54. The contact piece 55 is formed on the tip end side of the long side 52. The contact piece 56 is formed on the tip end side of the short side 53. At the tip end of the long side 52, a chamfered portion 52*a* is formed by obliquely cutting the angle or the corner in order to reduce frictional resistance, and the upper portion of the tip end thereof is a stopper end 58. In addition, at the connection portion 54, the locked portion 57 for fixing to the housing 41 is formed.

Figure 13:
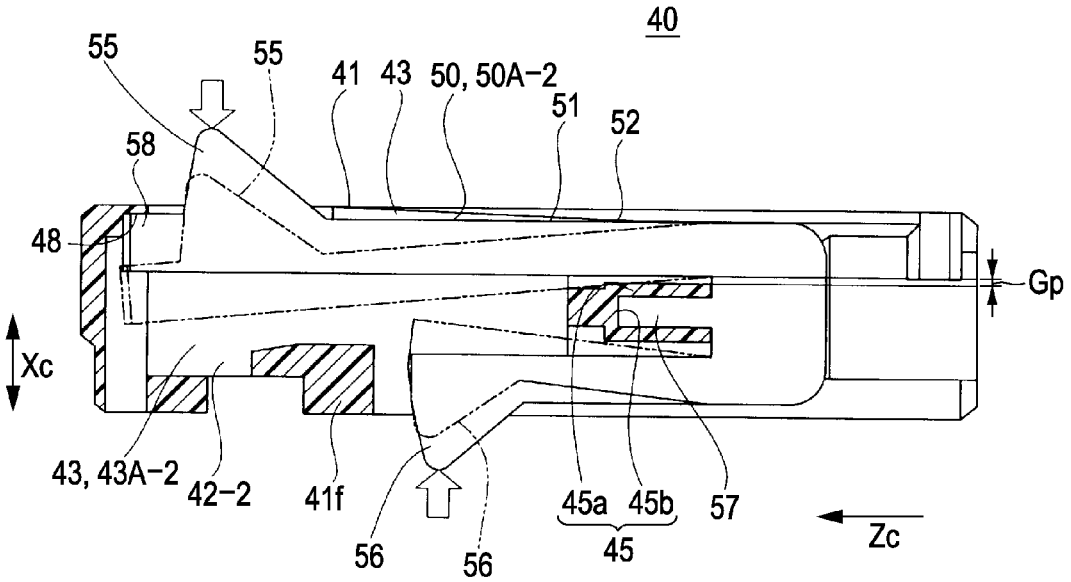
FIG. 13 is a cross-sectional view taken along the line XIII-XIII of FIG. 9.

FIG. 13 is a cross-sectional view taken along the line XIII-XIII of FIG. 9. Each of the slit formation walls 42 of the housing 41 is connected to a connection portion 41*f* and a lock portion 45. The lock portion 45 has a lock concave portion 45*b* formed in a U shape by a lock restriction piece 45*a*. The upper end of the lock restriction piece 45*a* is parallel to the long side 52 of the arm 51 of the contact terminal 50 and is formed at a gap Gp therefrom. As the contact terminal 50 is inserted into the slit 43 in the insertion direction Zc, the locked portion 57 is fitted to the lock portion 45 of the housing 41 and is thus fixed to a mounting position. In addition, the stopper end 58 of the tip end of the contact terminal 50 is locked by a locking end 48 formed inside the housing 41. By this configuration, the contact pieces 55 and 56 of the contact terminal 50 are disposed to protrude outward from the slits 43, and by being pressed in the bending direction Xc, the contact terminal 50 is elastically bent about the locked portion 57 fixed to the lock portion 45 as the fulcrum in the depth direction of the slit 43 as shown by the double-dot-dashed line.

In FIG. 11, by assembling a plurality of the same contact terminals 50, a first contact terminal unit 50A and a second contact terminal unit 50B are configured. The first contact terminal unit 50A includes contact terminals 50A-1 to 50A-3 respectively inserted into the five slits 43A-1 to 43A-3. The second contact terminal unit 50B includes contact terminals 50B-1 and 50B-2 respectively inserted into the four slits 43B-1 and 43B-2. The contact terminals 50B-1 and 50B-2 of the second contact terminal unit 50B are disposed between the contact terminals 50A-1 to 50A-3 of the first contact terminal unit 50A and are shifted by a distance L1 in the insertion direction Zc. In this manner, the positions of the contact pieces 55 and 56 become different in the insertion direction Zc by the arrangement of the first and second contact terminal units 50A and 50B, so that the contact pieces 55 and 56 have an arrangement in which the contact pieces 55 and 56 come in contact with the corresponding terminals of the terminal group 28*t* of the circuit board 28 of the cartridge 20 (FIG. 5) and the terminal group 38*t* of the contact point mechanism 38 of the body side circuit board 37 (FIG. 4). That is, the contact pieces 55 of the contact terminals 50A-1 to 50A-3 come in contact with the corresponding terminals of the terminal row 28*a* of the terminal group 28*t* of the circuit board 28, and the contact pieces 55 of the contact terminals 50B-1 and 50B-2 come in contact with the corresponding terminals of the terminal row 28*b* of the terminal group 28*t*. In addition, the contact pieces 56 of the contact terminals 50A-1 to 50A-3 come in contact with the corresponding terminals of the terminal row 38*a* of the terminal group 38*t* of the contact point mechanism 38, and the contact pieces 56 of the contact terminals 50B-1 and 50B-2 come in contact with the corresponding terminals of the terminal row 38*b* of the terminal group 38*t*. Accordingly, the contact terminals 50 respectively electrically connect the terminals of the circuit board 28 and the contact point mechanism 38.

Figure 14:
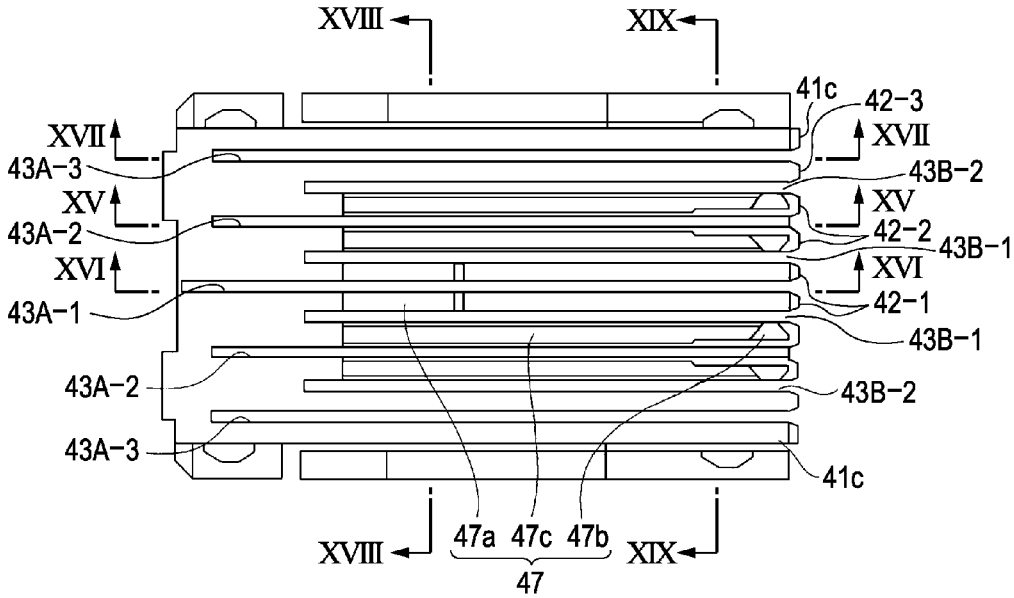
FIG. 14 is a plan view of the housing.
Figure 15:
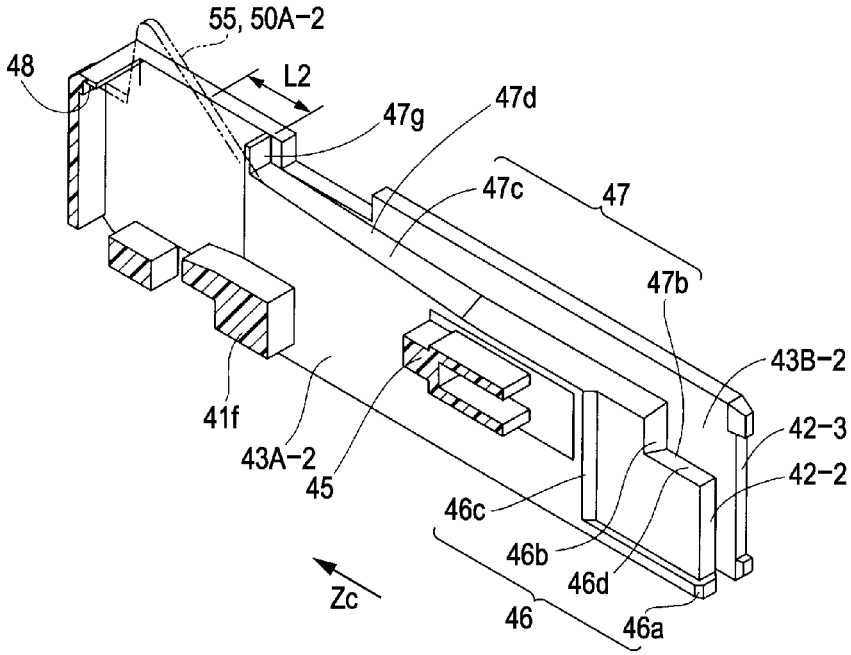
FIG. 15 is a perspective view taken along the line XV-XV of FIG. 14.

FIG. 14 is a plan view of the housing 41. FIG. 15 is a perspective view taken along the line XV-XV of FIG. 14 and illustrates the slit formation wall 42-2. The slit formation wall 42-2 has a guide portion 46 for guiding the insertion of the contact terminal 50 into the slit 43A-2. The guide portion 46 has a guide end surface 46*a*, a first guide inclined surface 46*b*, and a second guide inclined surface 46*c* in this order from the insertion side of the slit formation wall 42-2.

The guide end surface 46*a* has a shape formed by chamfering the end portion of the slit formation wall 42-2. The first guide inclined surface 46*b* is a surface inclined from the insertion side to the inner side toward the center of the slit 43A-2. The second guide inclined surface 46*c* is disposed further inwards from the first guide inclined surface 46*b* and is a surface inclined from the insertion side to the inner side toward the center of the slit 43A-2. In addition, the guide portion 46 has a guide seat 46*d* formed by cutting off the insertion side. The guide seat 46*d* forms a height difference so as to lower a part of the slit formation wall 42-2 in the bending direction Xc. In addition, the operations of the guide portion 46 will be described later.

Figure 10:
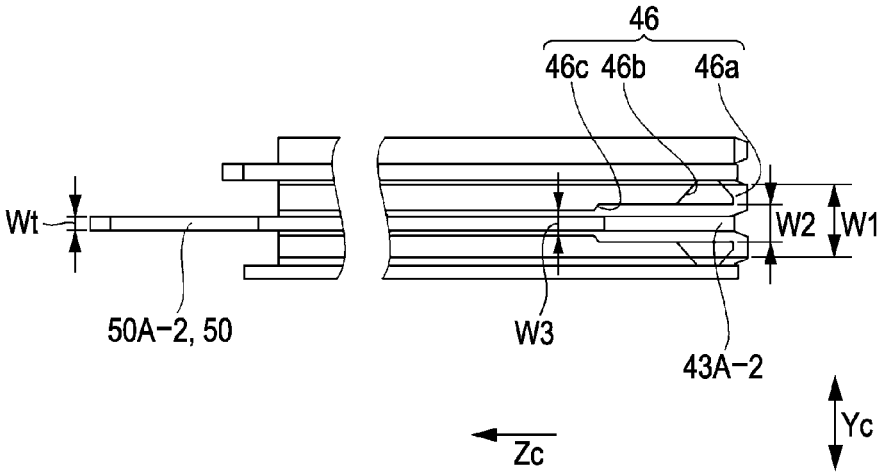
FIG. 10 is an explanatory view illustrating the slit widths of slits.

FIG. 10 is an explanatory view illustrating the widths of the slits of the slit 43A-2. As illustrated in FIG. 10, the slit width of the slit 43A-2 reduces from the insertion side in stages toward the mounting position of the contact terminal 50. For example, assuming that the thickness of the contact terminal 50 is Wt, the slit width is W1 at the guide seat 46*d* on the insertion side, is W2 on the inner side of the first guide inclined surface 46*b*, and is W3 at the mounting position on the inner side of the second guide inclined surface 46*c*, and W1>W2>W3 is satisfied.

Figure 16:
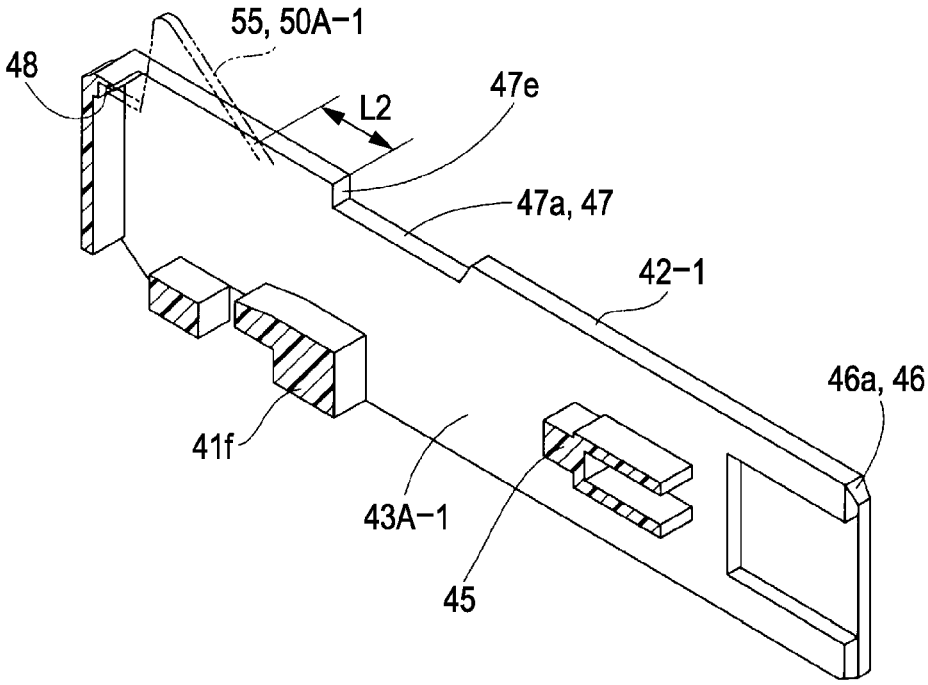
FIG. 16 is a perspective view taken along the line XVI-XVI of FIG. 14.
Figure 17:
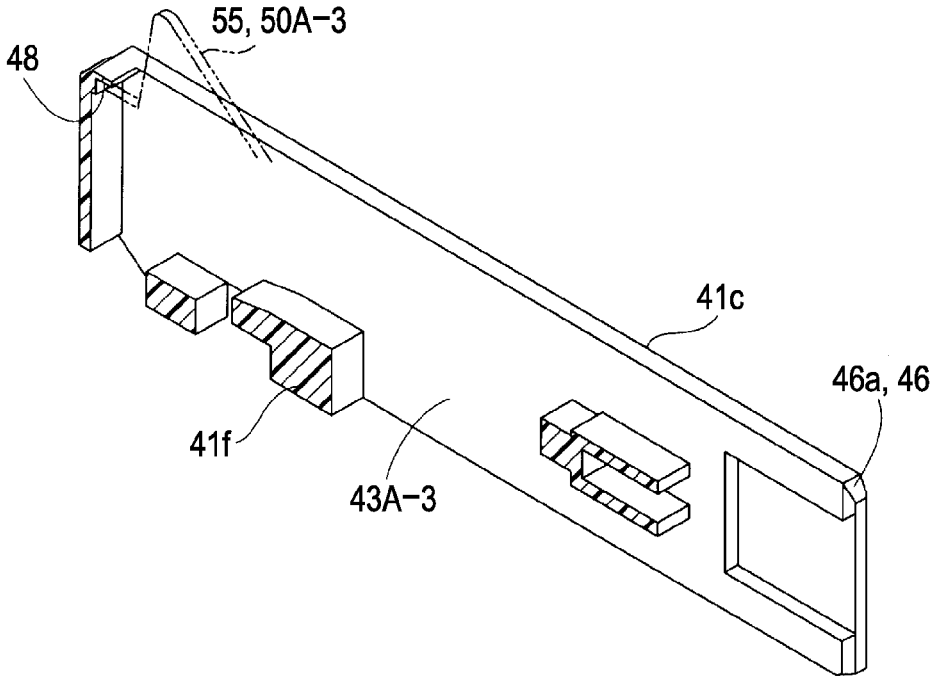
FIG. 17 is a perspective view taken along the line XVII-XVII of FIG. 14.

FIG. 16 is a perspective view taken along the line XVI-XVI of FIG. 14 and illustrates the slit formation wall 42-1. FIG. 17 is a perspective view taken along the line XVII-XVII of FIG. 14 and illustrates the side wall portion 41*c*. In the guide portion 46 mentioned above, other components than the guide end surface 46*a* are not formed at the slit formation wall 42-1 and the side wall portion 41*c*, and the slits 43A-1 and 43A-3 with substantially the same widths are formed. In addition, the slit 43B is also formed with the same width along the insertion direction Zc.

In FIGS. 15 and 16, in the slit formation walls 42-1 and 42-2, a trap portion 47 for holding foreign matter such as paper dust is provided on the surface where the slit 43 is formed. That is, in FIG. 16, the trap portion 47 includes a first trap portion 47*a* formed in the slit formation wall 42-1. The first trap portion 47*a* is obtained by forming a part of the upper side of the slit formation wall 42-1 as a concave portion, and the end portion on the inner side of the concave portion is formed as a protective wall 47*e*. The protective wall 47*e* is formed at a position distant from the contact piece 55 by a distance L2 in a state where the contact terminal 50 is not bent. In addition, in FIG. 15, the trap portion 47 includes a second trap portion 47*b* and a third trap portion 47*c* formed in the slit formation wall 42-2. The second trap portion 47*b* is a concave portion formed by the guide seat 46*d*. The third trap portion 47*c* is a concave portion formed on the upper side of the slit formation wall 42-2 in the insertion direction Zc and is formed as an inclined surface inclined toward the center of the slit 43A-2 from the insertion side to the inner side, that is, is formed so that the bottom face of the concave portion becomes shallow and the cross-sectional area of the concave portion is reduced. In addition, the third trap portion 47*c* has a protective wall 47*g* at the end portion of the concave portion on the inner side. The protective wall 47*g* is formed at a position distant from the contact piece 55 by the distance L2.

Figure 18:
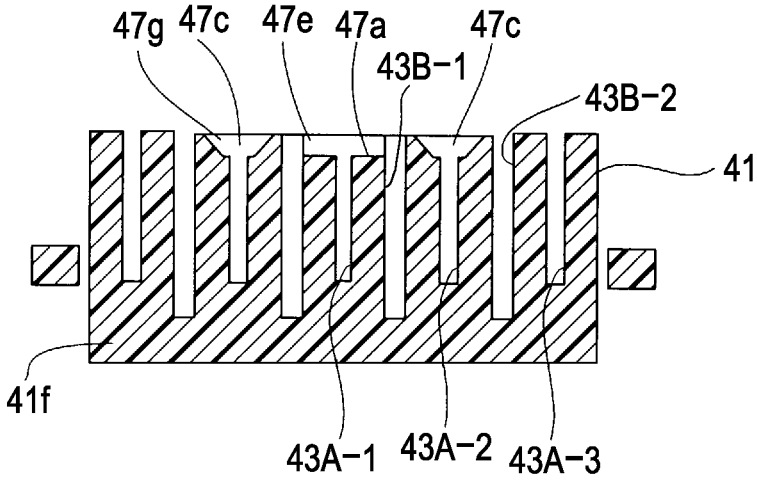
FIG. 18 is a cross-sectional view taken along the line XVIII-XVIII of FIG. 14.
Figure 19:
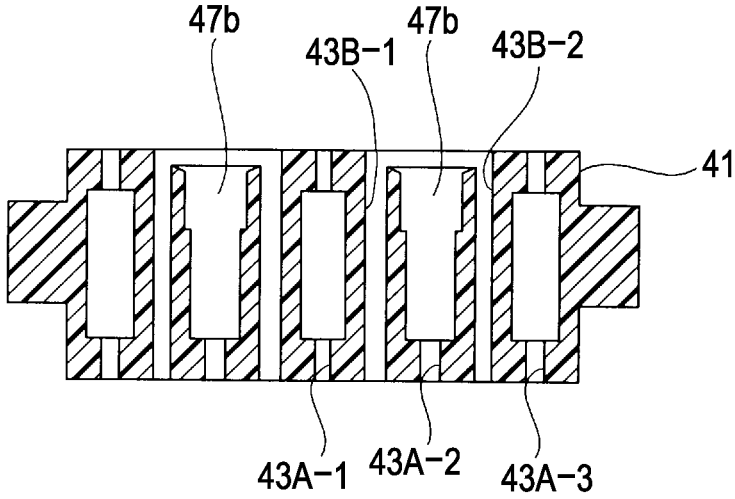
FIG. 19 is a cross-sectional view taken along the line XIX-XIX of FIG. 14.

FIG. 18 is a cross-sectional view taken along the line XVIII-XVIII of FIG. 14, and FIG. 19 is a cross-sectional view taken along the line XIX-XIX of FIG. 14. As illustrated in FIG. 18, the first trap portion 47*a* is a concave portion having a substantially quadrangular cross-section with a shape in which the center portion of the cassette side wall 41*a* of the housing 41 is cut off. The third trap portions 47*c* are on both sides of the first trap portion 47*a* and are concave portions with a shape in which the upper portion of the cassette side wall 41*a* of the housing 41 is cut off to have a triangular cross-section. In addition, as illustrated in FIG. 19, the second trap portion 47*b* is a concave portion with a wide space formed by the guide seat 46*d*. The operations of the trap portion 47 will be described later.

4. Assembly Operation of Terminal Module 40

Figure 20:
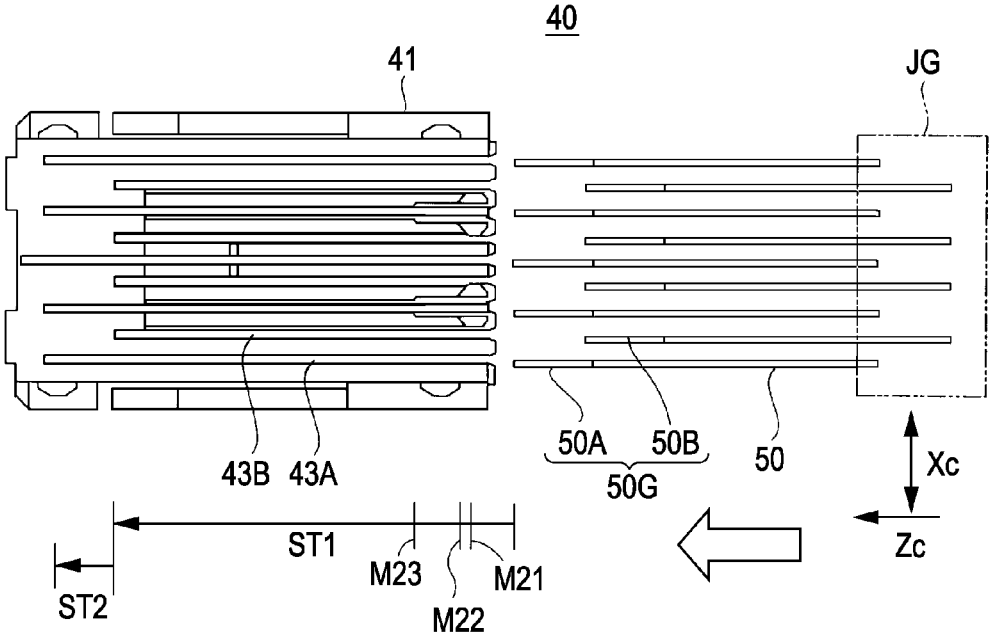
FIG. 20 is an explanatory view illustrating an assembly process of the terminal module.

FIG. 20 is an explanatory view illustrating an assembly process of the terminal module 40. In order to manufacture the terminal module 40, the following process may be performed. First, each member of the terminal module 40 is prepared. That is, the housing 41 is formed by resin injection molding or the like, and the nine contact terminals 50 with the same shape are manufactured by punching such as press forming. Subsequently, the nine contact terminals 50 are set in a jig JG. Here, the five contact terminals 50A-1 to 50A-3 are set on the inner side and the four contact terminals 50B-1 and 50B-2 are set on the insertion side to alternate with each other.

Figure 21:
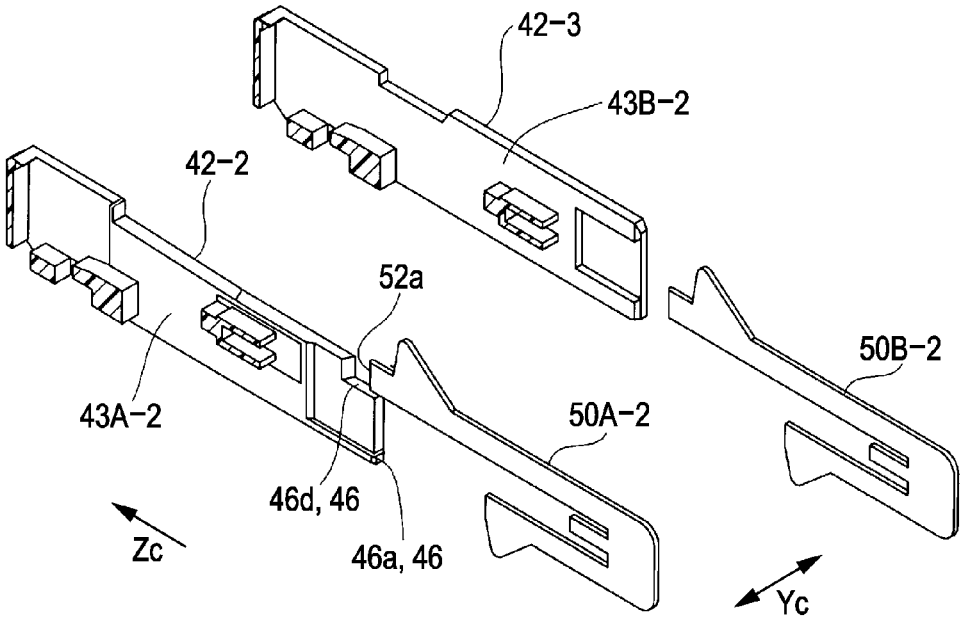
FIG. 21 is an explanatory view illustrating an insertion operation of the contact terminal into the housing.
Figure 22:
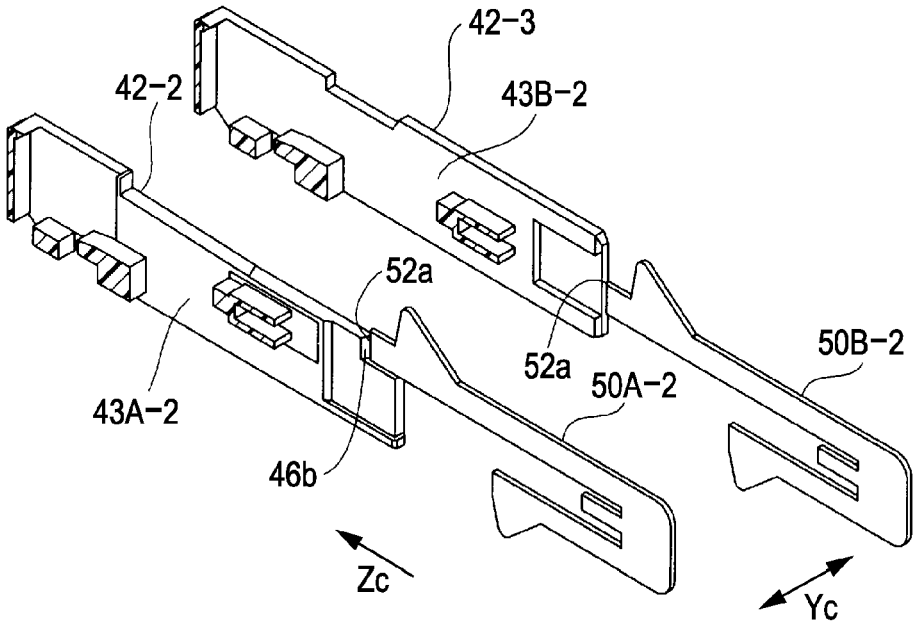
FIG. 22 is an explanatory view illustrating the insertion operation continued from FIG. 21.
Figure 23:
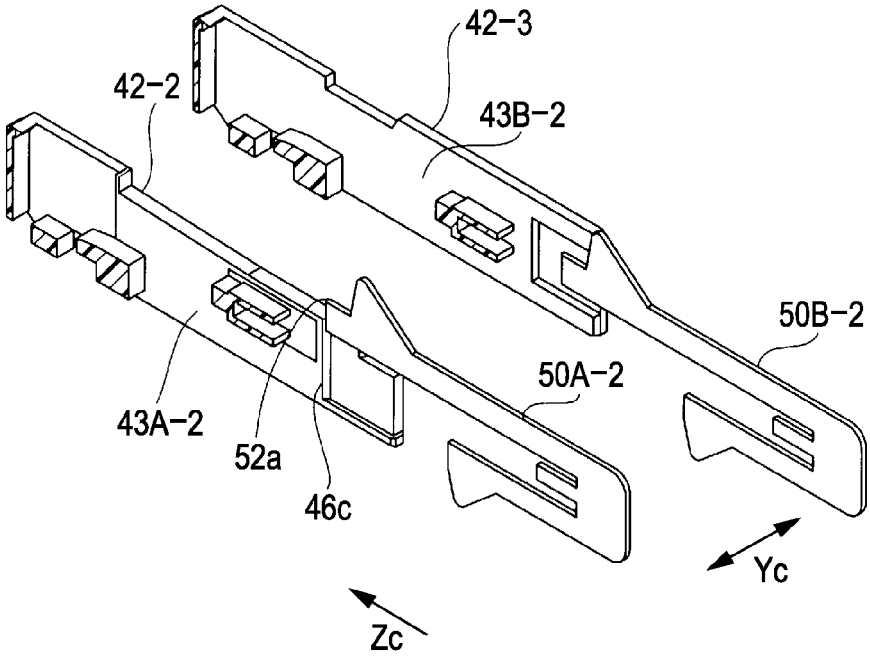
FIG. 23 is an explanatory view illustrating the insertion operation continued from FIG. 22.

Next, the first contact terminal unit 50A on the inner side is positioned by the corresponding slit 43A, and by moving the jig JG toward the terminal module 40 side by strokes ST1 and ST2 in two stages, the contact terminal 50 is mounted in the slit 43 (43A and 43B). FIGS. 21 to 23 respectively illustrate the forms of movement of the contact terminals 50A-2 and 50B-1 at the insertion positions M21, M22, and M23 during the stroke ST1 in the first stage. In addition, the positions of the slit formation walls 42-1 and 42-2 in the arrangement direction Yc are illustrated to have a large interval for description. At the insertion position M21 of FIG. 21, in the nine contact terminals 50, the contact terminal 50A-2 is inserted into the slit 43A-2. Here, when the tip end of the contact terminal 50A-2 deviates from the center of the slit 43A-2 in the arrangement direction Yc, the chamfered portion 52*a* at the tip end of the contact terminal 50A-2 reaches the guide end surface 46*a* of the guide portion 46 and is aligned with the center of the slit 43A-2. In addition, when the contact terminal 50A-2 deviates in the bending direction Xc, the tip end of the contact terminal 50A-2 reaches the guide seat 46*d* and is positioned in the bending direction Xc. At the insertion position M22 of FIG. 22, when the contact terminal 50A-2 deviates from the slit 43A-2 in the arrangement direction Yc, the chambered portion 52*a* of the tip end of the contact terminal 50A-2 reaches the first guide inclined surface 46*b* and is aligned with the center. At the insertion position M23 of FIG. 23, when the contact terminal 50A-2 deviates from the slit 43A-2 in the arrangement direction Yc, the contact terminal 50A-2 reaches the second guide inclined surface 46*c* and is aligned with the center. In addition, after the stroke ST1 in the first stage is finished, during the stroke ST2 in the second stage, as illustrated in FIG. 13, the locked portion 57 of the contact terminal 50 is fitted with the lock portion 45 of the housing 41, and the stopper end 58 is locked by the locking end 48, thereby completing the process of mounting the contact terminal 50 in the slit 43.

5. Mounting Operation of Cartridge 20

Figure 24:
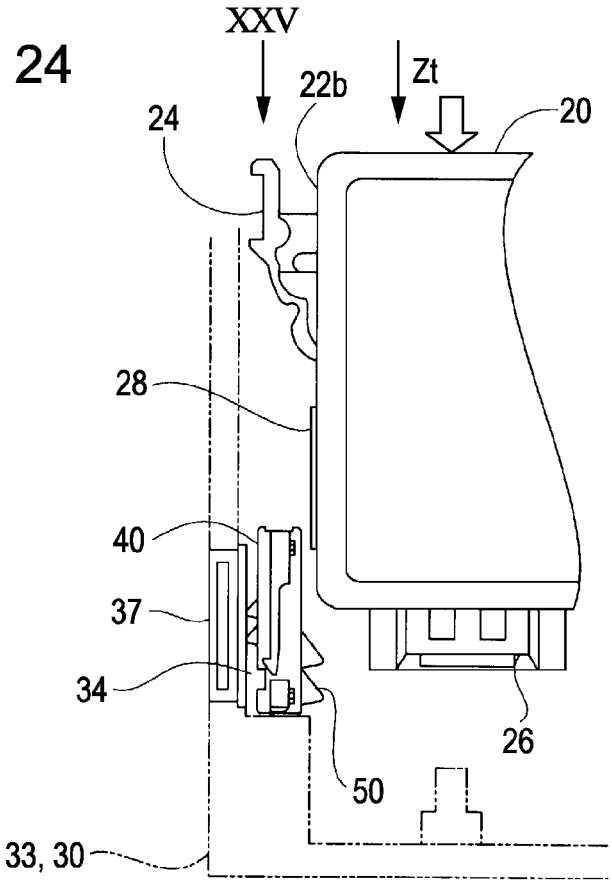
FIG. 24 is an explanatory view illustrating an operation of mounting the cartridge in a cartridge mounting portion of the holder.

In FIG. 24, in order to mount the cartridge 20 in the cartridge mounting portion 33 of the holder 30, the front face portion 22*b* and the rear face portion 22*c* (see FIG. 4) of the container body 22 are positioned in the cartridge mounting portion 33, and the cartridge 20 is inserted in the mounting direction Zt (the lower side in the figure) from the front side to the inner side of the mounting direction Zt. In addition, as the cantilevered lever 24 is pressed by an engagement portion (not shown) of the wall face of the cartridge mounting portion 33, the lever 24 is bent about the root portion as the fulcrum and rides on the engagement portion to be engaged, such that the cartridge 20 is mounted in the cartridge mounting portion 33. Here, the circuit board 28 of the cartridge 20 presses the contact terminal 50 of the terminal module 40 so as to be bent, such that the terminal group 28*t* (see FIG. 5) is electrically connected to the contact point of the contact terminal 50 of the terminal module 40.

6. Operational Effects of Embodiment

By the configuration of the terminal module 40 of the embodiment described above, the following effects are present.

6-1. Operational Effects of Guide Portion 46

(a) As illustrated in FIGS. 21 to 23, since the guide portion 46 includes the first and second guide inclined surfaces 46*b* and 46*c*, which allow the slit width of the mounting position to be reduced in stages along the insertion direction Zc, when the contact terminal 50A-2 is moved toward the mounting position of the slit, the first and second guide inclined surfaces 46*b* and 46*c* are sequentially guided, that is, a great force to align the contact terminal 50A-2 to one point is not applied, and thus a smooth insertion operation may be performed. Therefore, even though the contact terminal 50 has sight warpage or bending, the insertion operation into the slit 43 may be easily performed, thereby enhancing the yield of the assembly operation.

(b) As illustrated in FIG. 21, the guide seat 46*d* of the guide 46 supports the tip end of the contact terminal 50A-2 during the mounting operation of the contact terminal 50A-2 and thus restricts the position thereof in the bending direction, so that as illustrated in FIG. 13, the locked portion 57 is reliably guided by the lock portion 45, thereby facilitating the insertion operation of the contact terminal 50A-2.

(c) In FIGS. 11, 14, 15, and 20, the guide portion 46 is disposed to be left-right symmetric in the slits 43A-2 on both sides of the slit 43A-1 at the center of the housing 41, and is provided at points where the tip end of the contact terminal 50 is initially inserted into the slit 43A. Therefore, positioning of the plurality of the contact terminals 50 may be reliably performed by the small guide portion 46. That is, since the guide portion 46 is not provided in all the slits 43, the slit formation wall 42 is not made unnecessarily complex, and degradation of mechanical strength due to the formation of the concave portions is not caused.

(d) In FIGS. 21 to 23, the chamfered portion 52*a* formed at the tip end surface of the contact terminal 50 on the insertion side reduces frictional resistance when reaching the first and second guide inclined surfaces 46*b* and 46*c* and the like, so that the insertion operation of the contact terminal 50 may be smoothly performed.

(e) As illustrated in FIG. 13, since the stopper end 58 of the contact terminal 50 is positioned by the locking end 48 of the housing 41 at the mounting position of the contact terminal 50, the contact terminal 50 is reliably positioned with respect to the housing 41, and thus backlash may be prevented.

(f) As illustrated in FIG. 13, the contact terminal 50 is fixed to the housing 41 as the locked portion 57 is fitted to the lock portion 45 of the housing 41. However, since a gap Gp is set between the locked portion 57 and the lock restriction piece 45*a* of the housing 41, interference or contact of the arm 51 with the locked portion 57 is avoided even though dimensional errors occur during the manufacturing process of the locked portion 57 and the arm 51, and thus the contact terminal 50 may be simply mounted in the housing 41.

6-2. Operational Effects of Trap Portion 47

(a) When the cartridge 20 is removed from the holder 30, there may be a case where foreign matter such as paper dust is adhered to the vicinity of the circuit board 28 of the cartridge 20. There is a possibility of such foreign matter infiltrating between the circuit board 28 of the holder 30 and the terminal module 40 when the cartridge 20 is mounted in the holder 30 and impeding electrical connection. The trap portion 47 described with reference to FIGS. 15 and 16 and the like solves the problems caused by such foreign matter through the following operations. This will be described with reference to FIGS. 25 to 29.

Figure 25:
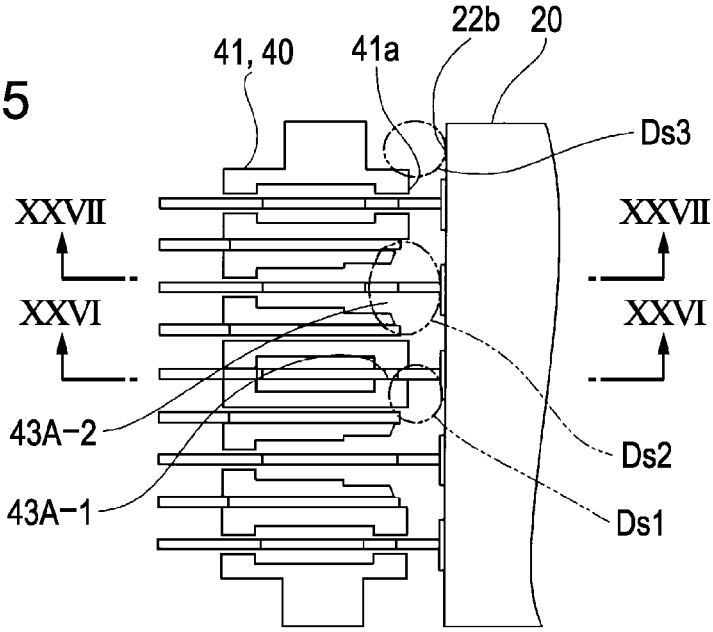
FIG. 25 is a diagram viewed in the direction of XXV of FIG. 24.

FIG. 25 is a diagram viewed in the direction of the arrow XXV of FIG. 24 and illustrates a state where pieces of foreign matter Ds1, Ds2, and Ds3 are interposed between the front face portion 22*b* of the cartridge 20 and the cassette side wall 41*a* of the terminal module 40. The piece of foreign matter Ds1 is substantially at the center of the cassette side wall 41*a* of the housing 41 and in the vicinity of the slit 43A-1, the piece of foreign matter Ds2 is substantially at a side of the cassette side wall 41*a* and in the vicinity of the slit 43A-2, and the pieces of foreign matter Ds1, Ds2, and Ds3 are at the end portions of the cassette side wall 41*a*.

Figure 26A:
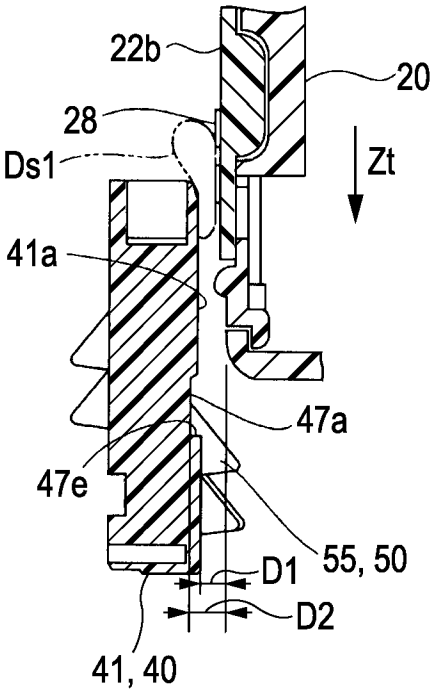
FIGS. 26A to 26C are explanatory views illustrating the insertion operation of the cartridge at positions of the cross-sections taken along the line XXVI-XXVI of FIG. 25.
Figure 26B:
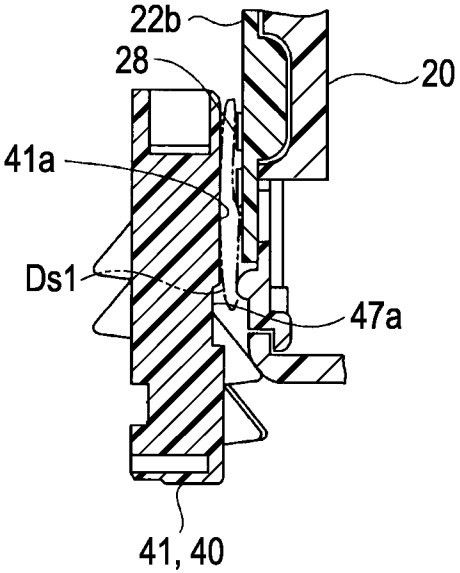
Figure 26C:
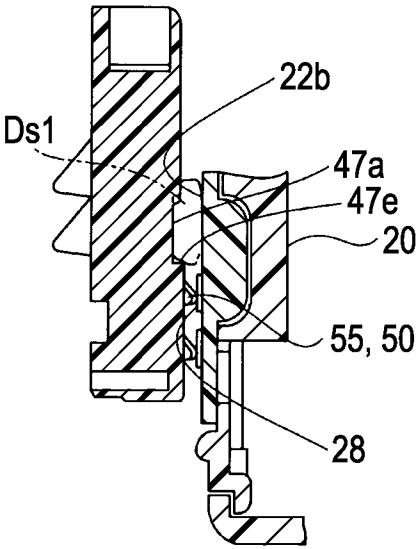

FIGS. 26A to 26C are cross-sectional views taken along the line XXVI-XXVI of FIG. 25, and FIGS. 27A to 27C are cross-sectional views taken along the line XXVII-XXVII of FIG. 25. In FIGS. 26A to 26C, the pieces of foreign matter Ds1 adhered to the center of the front face portion 22*b* of the cartridge 20 receives frictional force and moves in the mounting direction Zt while being compressed between the front face portion 22*b* of the cartridge 20 and the cassette side wall 41*a* of the housing 41 during the mounting operation of inserting the cartridge 20 into the holder 30 from the front side to the inner side in the mounting direction Zt as illustrated in FIGS. 26A and 26B, and is guided and held by the first trap portion 47*a* as illustrated in FIG. 26C. In the first trap portion 47*a*, the protective wall 47*e* is disposed on the front side in the mounting direction Zt with respect to the contact piece 55 of the contact terminal 50 and in a direction at right angles (in the intersecting direction) with respect to the mounting direction Zt. Here, regarding the interval between the wall face (a face where the slit 43 is formed) of the housing on the circuit board side and the wall side of the cartridge 20, the interval D1 of a point of the protective wall 47*e* is formed to be smaller than the interval D2 of the front side. Therefore, further movement of the piece of foreign matter Ds1 is restricted by the protective wall 47*e*. Therefore, the piece of foreign matter Ds1 does not reach a position between the contact piece 55 of the contact terminal 50 and the circuit board 28 and thus does not harm the electrical contact therebetween. In addition, in this embodiment, as the direction in which the protective wall 47*e* is formed, the direction at right angles is illustrated as the direction intersecting the mounting direction Zt. However, the direction is not limited to this, and an angle inclined at a certain degree with respect to the direction at right angles may be employed as long as the angle does not harm the holding of the piece of foreign matter Ds1.

Figure 27A:
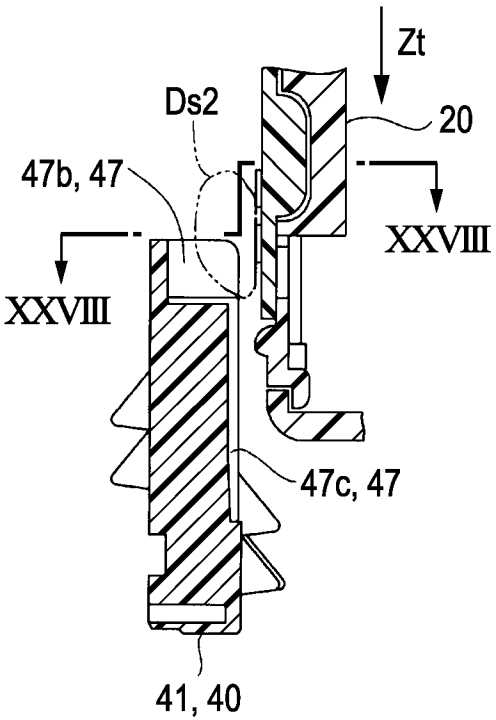
FIGS. 27A to 27C are explanatory views illustrating the insertion operation of the cartridge at positions of the cross-sections taken along the line XXVII-XXVII of FIG. 25.
Figure 27B:
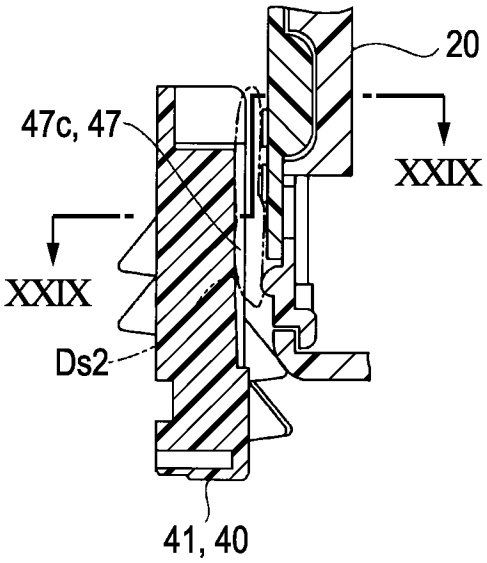
Figure 27C:
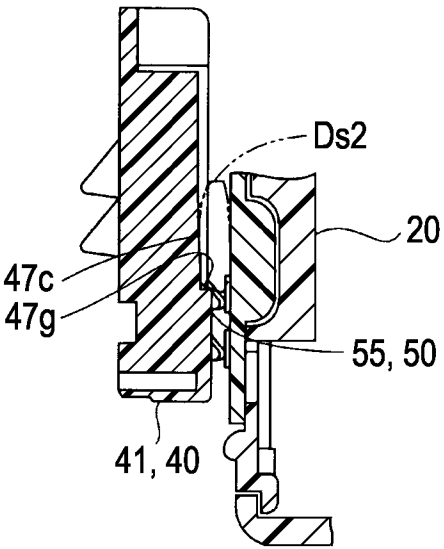
Figure 28:
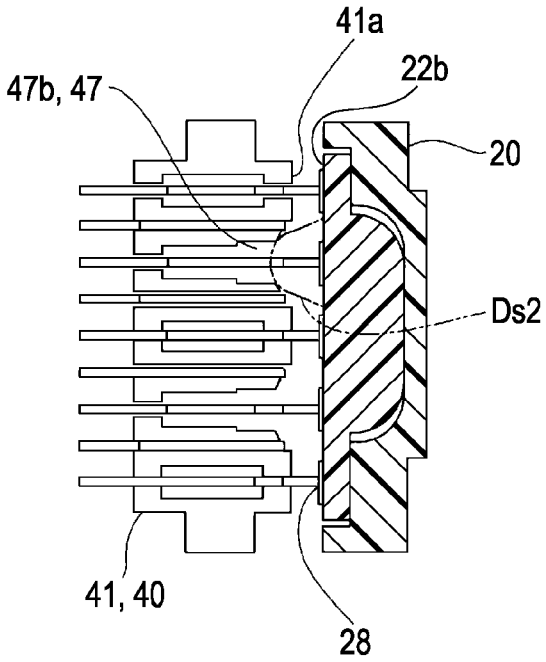
FIG. 28 is a cross-sectional view taken along the line XXVIII-XXVIII of FIG. 27A.
Figure 29:
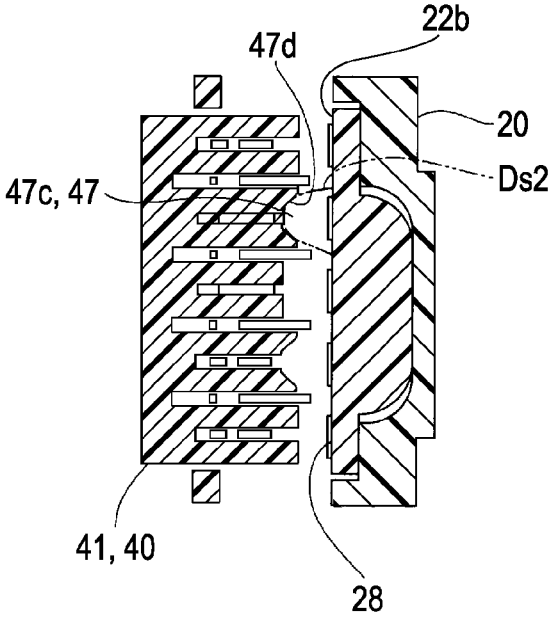
FIG. 29 is a cross-sectional view taken along the line XXIX-XXIX of FIG. 27B.

In FIGS. 27A to 27C, the piece of foreign matter Ds2 adhered to the side of the front side portion 22*b* of the cartridge 20 is moved in the mounting direction Zt as illustrated in FIG. 27C through the positions of FIGS. 27A and 27B during the mounting operation of the cartridge 20 to the holder. FIG. 28 is a cross-sectional view taken along the line XXVIII-XXVIII of FIG. 27A, and FIG. 29 is a cross-sectional view taken along the line XXIX-XXIX of FIG. 27B. As illustrated in FIGS. 27A and 28, the piece of foreign matter Ds2 is held in a state of being compressed by the second trap portion 47*b* of the trap portion 47, and receives frictional force and moves in the mounting direction Zt while being compressed between the front face portion 22*b* of the cartridge 20 and the cassette side wall 41*a* of the housing 41 along the third trap portion 47*c*. In addition, when the piece of foreign matter Ds2 reaches the protective wall 47*g* of the third trap portion 47*c*, further movement thereof is restricted by the protective wall 47*g*. Therefore, the piece of foreign matter Ds2 does not reach the position between the contact piece 55 of the contact terminal 50 and the circuit board 28 and thus does not harm the electrical contact therebetween.

(b) As illustrated in FIGS. 15 and 27A to 27C, the second trap portion 47*b* is disposed on the front side of the slit 43, is a large space formed by the guide seat 46*d* obtained by cutting off the part of the slit formation wall 42-2, and thus can capture large pieces of foreign matter.

(c) As illustrated in FIG. 29, the third trap portion 47*c* is a V-shaped groove formed by the inclined surface 47*d*, has a large contact area contacting foreign matter, and thus is able to obtain high frictional force, thereby reliably capturing foreign matter.

(d) As illustrated in FIG. 15, in the third trap portion 47*c*, the depth of the groove is gradually reduced by the inclined surface 47*d* in the insertion direction Zc, so that the third trap portion 47*c* may solidify and capture foreign matter. Therefore, foreign matter is not torn to shreds in reaching the vicinity of the contact piece 55.

(e) In FIGS. 15 and 16, since the trap portion 47 is provided with the first, second, and third trap portions 47*a*, 47*b*, and 47*c* with different cross-sectional shapes, foreign matter with various shapes may be reliably prevented from reaching the vicinity of the contact piece 55.

(f) As illustrated in FIG. 15, the first trap portion 47*a* is formed by the guide seat 46*d* obtained by cutting off the part of the slit formation wall 42-2 at the opening of the slit 43A-2 and thus also has the function as the opening of the slit 43A-2, so that the configuration becomes simple.

(g) The piece of foreign matter Ds3 adhered to the end portion of the front face portion 22*b* of the cartridge 20 as illustrated in FIG. 25 is more likely to drop off the side by coming in contact with the cassette side wall 41*a* of the housing 41 of the terminal module 40 and is less likely to reach the contact piece 55 of the contact terminal 50 as illustrated in FIGS. 26A to 26C or FIGS. 27A to 27C. As described above, on both sides of the housing 41, a part of the slit formation wall 42 is not cut off or a concave portion is not formed to provide the trap portion 47, and thus the mechanical strength of the housing 41 is not degraded.

Figure 30:
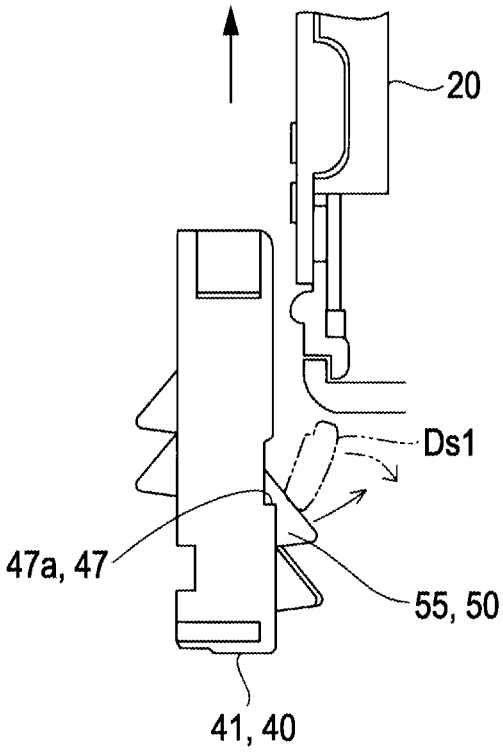
FIG. 30 is an explanatory view illustrating the state where the cartridge is removed from the holder.

(h) FIG. 30 is an explanatory view illustrating the state where the cartridge 20 is removed from the holder, that is, a state where the cartridge 20 is removed from the state of FIG. 26C. In the state where the piece of foreign matter Ds1 is held in the first trap portion 47*a* of the trap portion 47 as illustrated in FIG. 26C, when the cartridge 20 is removed from the holder, as illustrated in FIG. 30, the arm 51 of the contact terminal 50 disposed to reach the first trap portion 47*a* causes the foreign matter to be ejected from the first trap portion 47*a* and be removed from the vicinity of the contact piece 55 during the return under elastic force. Therefore, remaining of foreign matter in the vicinity of the contact piece 55 of the contact terminal 50 of the terminal module 40 may be avoided.

7. Another Embodiment

The invention is not limited to the above embodiments and may be embodied in various forms without departing from the scope of the gist, and for example, the following embodiment may be employed.

For example, a double-sided terminal is described as the terminal module 40 of the embodiment described above. However, the invention is not limited thereto and may be applied to a case where a terminal is provided on one side.

What is claimed is:

1. A terminal module comprising:

a housing having a plurality of slits arranged in parallel to each other; and a plurality of contact terminals, each of which has an arm and a contact piece formed at one end of the arm and each of which is mounted in a corresponding one of the plurality of slits in a mounting position in the corresponding slit by being inserted into the corresponding slit through an insertion opening in the corresponding slit in an insertion direction intersecting an arrangement direction of the slits, the contact pieces being connected to external terminals as the arms are elastically deformed in a bending direction aligned with a depth direction of the slits, wherein each slit has a width that is greater at the insertion opening than that at the mounting position of the contact terminal, and the housing has a guide portion which is formed along the insertion direction of the slits, has a guide surface inclined toward the mounting position from the insertion openings of the slits, and guides the contact terminals toward the mounting position as a tip end of an insertion side of the contact terminal reaches the guide surface.

2. The terminal module according to claim 1, wherein a plurality of the guide surfaces are formed so that the widths of at some of the slits is reduced from the insertion opening toward the mounting position in stages.

3. The terminal module according to claim 2, wherein the guide portion is provided to only some of the plurality of slits, each of the plurality of contact terminals has a first contact terminal and a second contact terminal, and a tip end side of the first contact terminal is disposed on a side further forwards in the corresponding slit in the insertion direction than a tip end side of the second contact terminal, and each first contact terminal is disposed to be mounted in a corresponding slit having the guide portion.

4. The terminal module according to claim 3 wherein the plurality of slits having the guide portion are disposed to be symmetric with respect to a center shaft in the arrangement direction of the slits in the housing.

5. The terminal module according to claim 4, wherein the housing has a guide seat which is formed on an insertion opening side of the slits and restricts a position of the contact terminals in the bending direction by reaching a tip end of each contact terminal.

6. The terminal module according to claim 3, wherein the first and second contact terminals have the same shape, and the contact pieces are disposed at different positions along the insertion direction.

7. The terminal module according to claim 5, wherein a chamfered portion is formed at a tip end of each contact terminal to reduce frictional resistance when coming in contact with the guide surface for the corresponding slit.

8. The terminal module according to claim 7, further comprising:

a stopper end which is provided at the tip end of the contact terminals; and a locking end which restricts outward movement of the contact terminals from the slits in the bending direction by being locked by the stopper end at the mounting positions of the slits in the housing.

9. The terminal module according to claim 8, wherein each contact terminal is formed in a shape in which two parallel sides are connected with the arm, and the contact pieces are formed at both ends of the arm so as to move outside the corresponding slit on an opposite side to the bending direction.

* * * * *